US009587655B2

(12) United States Patent
Ophardt et al.

(10) Patent No.: US 9,587,655 B2
(45) Date of Patent: Mar. 7, 2017

(54) TELESCOPIC BELL PISTON FOR PUMP

(71) Applicant: GOTOHTI.COM INC., Beamsville (CA)

(72) Inventors: Heiner Ophardt, Arisdorf (CH); Ali Mirbach, Issum (DE)

(73) Assignee: GOTOHTI.COM INC., Beamsville (CA)

( * ) Notice: Subject to any disclaimer, the term of this patent is extended or adjusted under 35 U.S.C. 154(b) by 849 days.

(21) Appl. No.: 13/919,583

(22) Filed: Jun. 17, 2013

(65) Prior Publication Data

US 2013/0333551 A1 Dec. 19, 2013

(30) Foreign Application Priority Data

Jun. 19, 2012 (CA) ..... 2780503

(51) Int. Cl.
*F15B 15/16* (2006.01)
*B05B 11/00* (2006.01)

(52) U.S. Cl.
CPC ..... *F15B 15/16* (2013.01); *B05B 11/007* (2013.01); *B05B 11/3001* (2013.01); *B05B 11/3097* (2013.01)

(58) Field of Classification Search
CPC ..... B05B 11/3001; B05B 11/3028; B05B 11/3097; B05B 11/0043; B05B 11/007; B05B 11/306; F15B 15/16
See application file for complete search history.

(56) References Cited

U.S. PATENT DOCUMENTS

| | | | | |
|---|---|---|---|---|
| 5,165,577 | A | 11/1992 | Ophardt | |
| 5,282,552 | A | 2/1994 | Ophardt | |
| 5,676,277 | A | 10/1997 | Ophardt | |
| 5,975,360 | A | 11/1999 | Ophardt | |
| 6,082,586 | A * | 7/2000 | Banks | A47K 5/14 222/105 |
| 6,343,724 | B1 | 2/2002 | Ophardt et al. | |
| 6,540,157 | B2 | 4/2003 | Ophardt | |
| 6,557,736 | B1 * | 5/2003 | Ophardt | B05B 11/3001 222/321.7 |
| 6,601,736 | B2 | 8/2003 | Ophardt et al. | |
| 7,267,251 | B2 | 9/2007 | Ophardt | |
| 7,303,099 | B2 | 12/2007 | Ophardt | |
| 7,815,076 | B2 | 10/2010 | Ophardt | |
| 7,959,037 | B2 * | 6/2011 | Ophardt | B05B 11/3067 222/321.1 |
| 8,360,286 | B2 | 1/2013 | Shi et al. | |
| 8,413,855 | B2 | 4/2013 | Ophardt et al. | |
| 8,474,664 | B2 | 7/2013 | Ophardt et al. | |
| 8,528,792 | B2 * | 9/2013 | Ophardt | B05B 11/007 222/181.2 |

* cited by examiner

*Primary Examiner* — Thomas E Lazo
*Assistant Examiner* — Abiy Teka
(74) *Attorney, Agent, or Firm* — Thorpe North & Western LLP

(57) ABSTRACT

A piston pump dispenser in which a volume in a compartment defined inside a piston chamber-forming member and between axially spaced discs on a piston varies with movement of the piston in a cycle of operation due to the piston having a tubular portion between the discs which varies in axial length. The tubular portion has a circumferentially extending wall in the shape of a solid of revolution about an axis of the piston with opening through the wall for fluid flow. The tubular portion acts as a spring to axially bias the axially spaced disc apart.

20 Claims, 19 Drawing Sheets

TELESCOPIC BELL PISTON FOR PUMP

SCOPE OF THE INVENTION

This invention relates generally to a piston for a pump and, more particularly, to an arrangement for a disposable variable length piston for piston pumps for dispensing flowable materials.

BACKGROUND OF THE INVENTION

Many dispensers of liquid such as hands soaps, creams, honey, ketchup and mustard and other viscous fluids which dispense fluid from a nozzle leave a drop of liquid at the end of the outlet. This can be a problem that the liquid may harden, as creating an obstruction which reduces the area for fluid flow in future dispensing. The obstruction can result in future dispensing through a small area orifice resulting in spraying in various directions such as onto a wall or user to stain the wall or user or more disadvantageously into the eyes of a user.

Many dispensers of material such as creams and for example liquid honey have the problem of stringing in which an elongate string of fluid hangs from fluid in the outlet and dangles from the outlet after dispensing an allotment of fluid. With passage of time the string may form into a droplet and drop from the outlet giving the appearance that the dispenser is leaking.

Pump assemblies for fluid dispensers are well known. Such pump dispenser includes those invented by the inventor of this present application including those disclosed in U.S. Pat. No. 5,165,577, issued Nov. 24, 1992; U.S. Pat. No. 5,282,552, issued Feb. 1, 1994; U.S. Pat. No. 5,676,277, issued Oct. 14, 1997, U.S. Pat. No. 5,975,360, issued Nov. 2, 1999, and U.S. Pat. No. 7,267,251, issued Sep. 11, 2007, the disclosures of which are incorporated herein by reference. Of these U.S. Pat. No. 7,267,251 teaches a piston pump in which there is, in a charging stroke of a piston moving in a stepped chamber, drawback of fluid from an outlet through which the fluid is dispensed from the chamber in a dispensing stroke due to the provision of stepped chamber as having two portions of different diameter. Such an arrangement while advantageous has the disadvantage of requiring a stepped chamber.

Many previously known piston pumps suffer the disadvantage that the pistons for the pump are difficult to manufacture.

SUMMARY OF THE INVENTION

To at least partially overcome these disadvantages of previously known devices the present invention provides a piston pump having a piston and a piston chamber forming member in which the piston forms a compartment of variable axial length inside a piston chamber between a piston head portion of the piston and a piston base portion of the piston spaced axially from the piston head portion by reason of a resilient tubular intermediate portion of the piston being disposed between the piston head portion and piston base portion, biasing them axially apart and preferably with openings radially through the tubular piston intermediate portion for fluid flow.

The present invention is particularly applicable to fluid dispensers which fluid is to be dispensed out of an outlet with the outlet forming an open end of a tubular member. In many applications, the tubular member has its outlet opening downwardly and fluid passing through the tubular member is drawn downwardly by the forces of gravity.

An object of the present invention is to provide a fluid dispenser in which after dispensing fluid out an outlet draws fluid back through the outlet to reduce dripping and/or stringing.

Another object of the present invention is to provide a simplified piston pump for dispensing fluid and after dispensing draws back fluid from the outlet of a nozzle from which the fluid has been dispensed.

Another aspect is to provide a valving member which varies the extent to which fluid flow is permitted therethrough with axial deflection of a tubular wall.

Accordingly, in one aspect, the present invention provides a piston-forming element for reciprocal sliding within a chamber in a piston pump, the piston-forming element disposed about a central axis and having an inner head portion, an outer base portion and a tubular portion intermediate the head portion and the base portion, the tubular member coupled at an outer end to the base portion and at an inner end to the head portion, a head disc extending radially outwardly from the head portion substantially preventing fluid flow in the chamber past the head disc in an inward direction and permitting fluid flow in the chamber past the head disc in an outward direction, a base disc extending radially outwardly from the stem of the base portion axially outwardly from the head disc engaging the chamber wall circumferentially thereabout substantially preventing fluid flow in the chamber past the base disc in an inward direction, the base portion having a central axially extending hollow stem having a central passageway open at an outer end forming an outlet, the passageway extending from the outlet inwardly to an inner end open to the chamber between the head disc and the base disc, the tubular member having a wall extending between inner end and the outer end, the wall having the shape of a solid of revolution rotated about the central axis, the wall having a radially outwardly directed outer wall surface and a radially inwardly directed inner wall surface, at least one opening radially through the wall member from the outer wall surface to the inner wall surface, the tubular member reducing in length axially between the base portion and the head portion when axially directed compression forces are applied to the tubular member by the base portion, the tubular member being resilient having an inherent bias to assume an initial unbiased configuration of an unbiased length measured axially along the central axis, the tubular member resiliently deflectable to biased configurations each having a length measured axially along the central axis less than the unbiased length, the inherent bias of the resilient member biasing the tubular member to return towards the unbiased configuration from any one of the biased configurations, with a reduction in the length of the tubular member as measured axially along the central axis the outer wall surface increases in convexity as seen in cross-sectional side view in any flat plane including the central axis extending radially from the axis.

In a further aspect, the present invention provides a pump for dispensing fluids from a reservoir, comprising:

a piston chamber-forming member having an elongate chamber, said chamber having a chamber wall, an outer open end and an inner end in communication with the reservoir;

a one-way valve between the reservoir and the chamber permitting fluid flow through the inner end of the chamber, only from the reservoir to the chamber;

a piston-forming element slidably received in the chamber extending outwardly from the open end thereof;

the piston-forming element having an inner head portion, an outer base portion and a variable length portion intermediate the head portion and the base portion joining the head portion and the base portion, a head disc extending radially outwardly from the head portion engaging the chamber wall circumferentially thereabout to substantially prevent fluid flow in the chamber past the head disc in an inward direction, the head disc elastically deforming away from the chamber wall to permit fluid flow in the chamber past the head disc in an outward direction, a base disc extending radially outwardly from the stem of the base portion axially outwardly from the head disc engaging the chamber wall circumferentially thereabout to substantially prevent fluid flow in the chamber past the base disc in an inward direction, the base portion having a central axially extending hollow stem having a central passageway open at an outer end forming an outlet, the passageway extending from the outlet inwardly to an inner end open to the chamber between the head disc and the base disc, the piston-forming element received in the piston chamber-forming member reciprocally coaxially slidable inwardly and outwardly by movement of the base portion in the chamber between a retracted position and an extended position in a cycle of operation to draw fluid from the reservoir and dispense it from the outlet, the piston-forming element and the chamber coaxially disposed about a central axis, the variable length portion comprising a tubular member coupled at an outer end to the base portion and at an inner end to the head portion, the tubular member transmitting axially directed tension force applied thereto by the base portion from the base portion to the head portion, the tubular member reducing in length axially between the base portion and the head portion when axially directed compression forces are applied to the tubular member by the base portion, the tubular member having a wall extending between inner end and the outer end, the wall having the shape of a solid of revolution rotated about the central axis, the wall having a radially outwardly directed outer wall surface and a radially inwardly directed inner wall surface, at least one opening radially through the wall member from the outer wall surface to the inner wall surface, the tubular member being resilient having an inherent bias to assume an initial unbiased configuration of an unbiased length measured along the central axis, the tubular member resiliently deflectable to biased configurations each having a length measured along the central axis less than the unbiased length, the inherent bias of the resilient member biasing the tubular member to return towards the unbiased configuration from any one of the biased configurations, a reduction in the length of the tubular member as measured along the central axis corresponds to the outer wall surface increasing in convexity as seen in cross-sectional side view in flat planes including the central axis extending radially from the axis.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
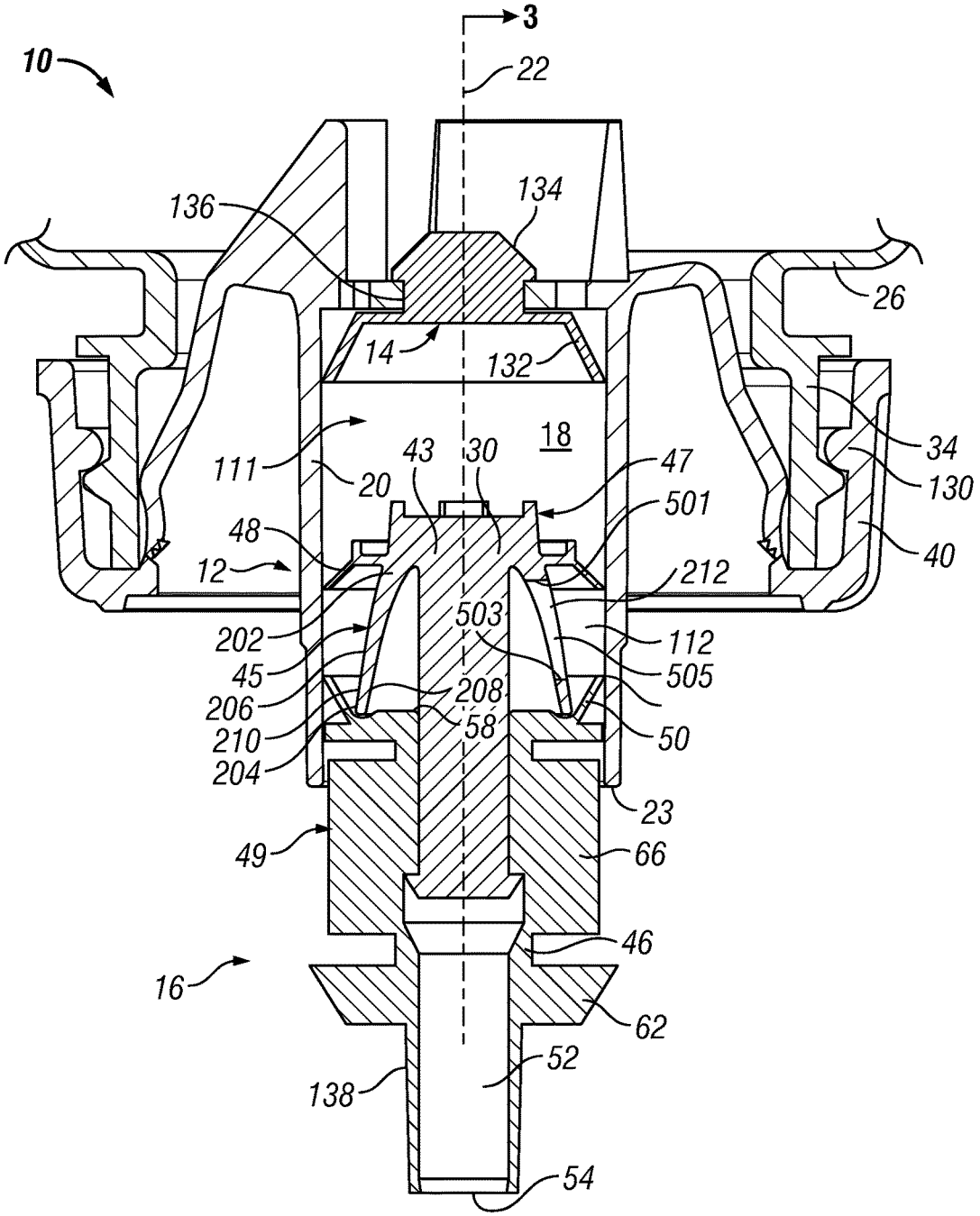
FIG. 1 is a cross-sectional side view of a pump in accordance with a first embodiment of the present invention with a piston in an uncompressed condition.

Reference is made first to the pump shown in FIG. 1 comprising a pump assembly 10 secured to a reservoir or container 26 having a threaded neck 34. The pump assembly has a body 12, a one-way valve 14 and a piston 16.

The body 12 provides a cylindrical chamber 18 in which the piston 16 is axially reciprocally slidable in a cycle of operation so as to draw fluid from within the container 26 and dispense it out of an outlet 54. The chamber 18 has a cylindrical chamber wall 20 disposed coaxially about a central chamber axis 22.

The piston 16 has a head portion 47, a variable length intermediate portion 45 and a base portion 49.

The head portion 47 includes a centrally extending head stem 30 upon which a head disc 48 is mounted. The head disc 48 extends radially outwardly from the head stem 30 as a circular resilient flexible disc located at the inwardmost end of the head portion 47 and extending radially therefrom. The head disc 48 is sized to circumferentially abut the inner chamber wall 20 substantially preventing fluid flow therepast inwardly in the chamber 18. The head disc 48 is formed as a thin resilient disc having an elastically deformable edge portion to engage the chamber wall 20. The edge portion extends radially outwardly and in a direction axially outwardly of the chamber 18. The edge portion is adapted to deflect radially inwardly away from the chamber wall 20 to permit fluid flow outwardly in the chamber 18 therepast.

Figure 5:
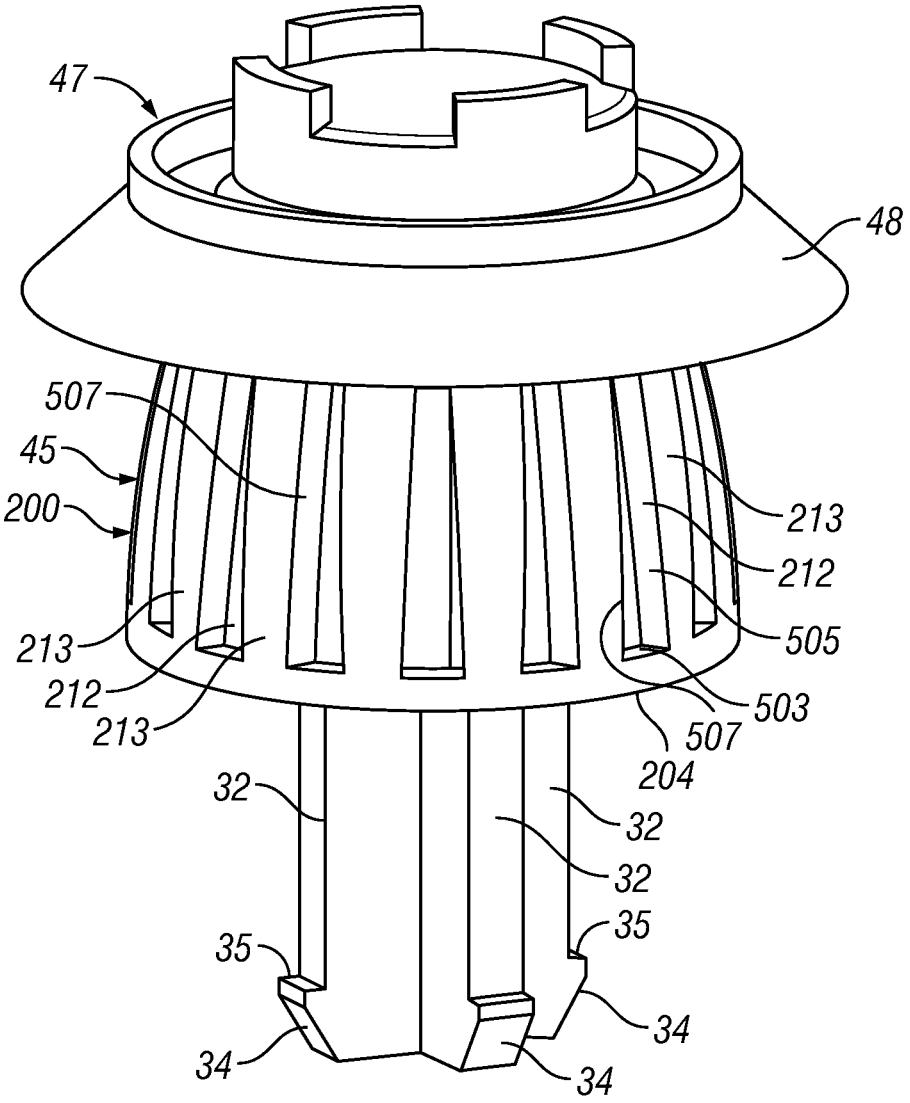
FIG. 5 is a pictorial view of a head portion of the piston of the pump shown in FIG. 1.
Figure 6:
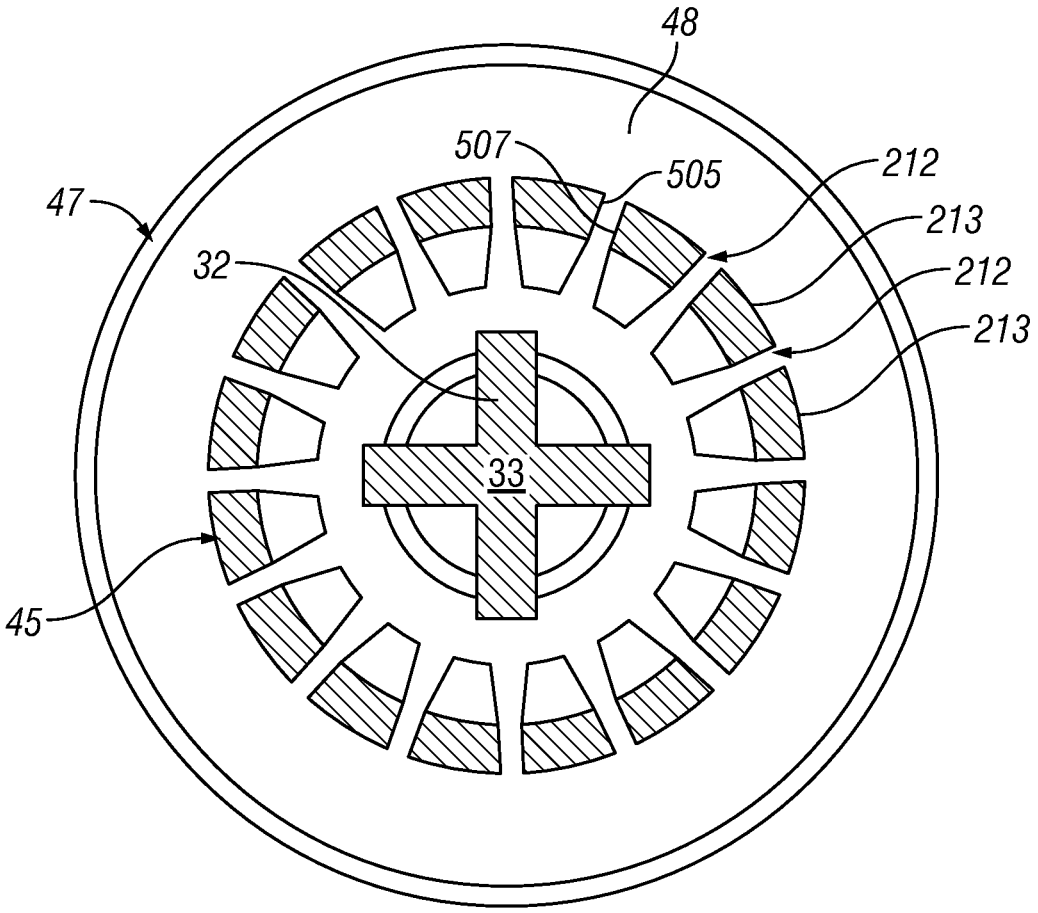
FIG. 6 is a cross-sectional end view of the head portion of the piston along section line 6-6' in FIG. 2.
Figure 7:
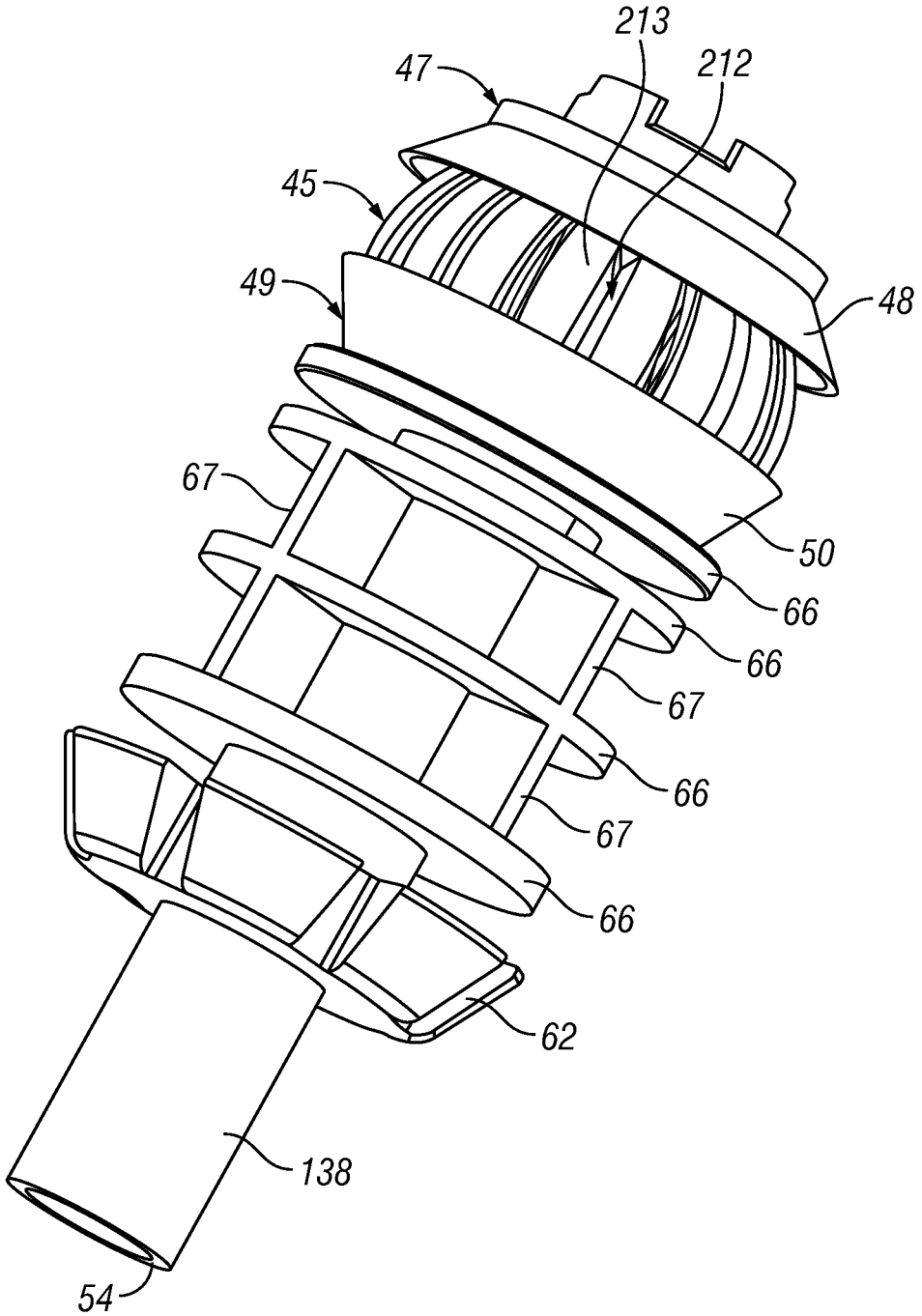
FIG. 7 is a pictorial view of the piston of the pump of FIG. 1 but in the first compressed condition of FIG. 3.
Figure 8:
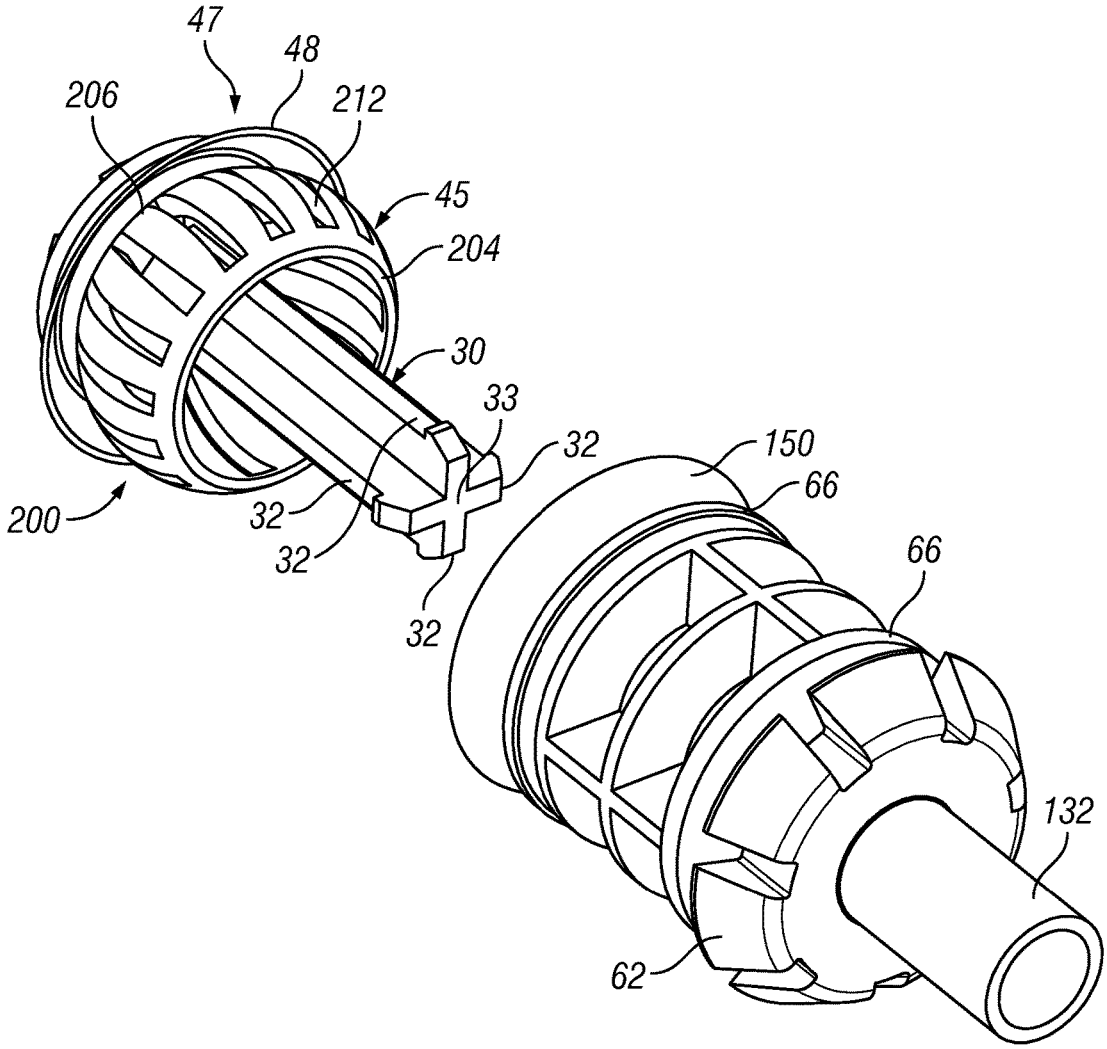
FIG. 8 is an exploded pictorial view of the piston of FIG. 7.
Figure 9:
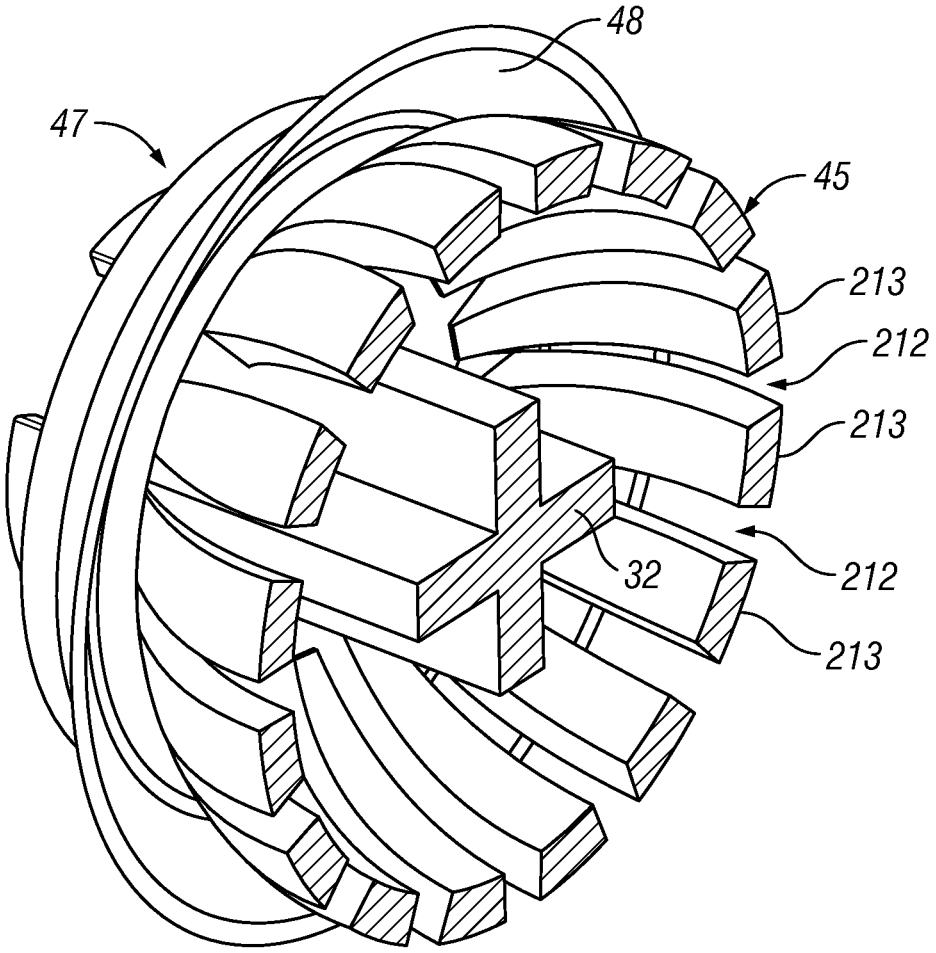
FIG. 9 is a partial pictorial view showing the piston head of the piston of FIGS. 7 and 8 cross-sectioned along section 9-9' in FIG. 3.

As best seen in FIGS. 5 and 8, axially outwardly of the head disc 48, the head stem 30 has a center 33 coaxial about the axis from which four elongate arms 32 extend radially outwardly and axially to provide an X shape in cross-section as seen in FIGS. 6 and 8. Each arm 32 carries at its outer end a radially outwardly extending hooking member 34 with an axially inwardly directed catching surface 35.

The variable length intermediate portion 45 comprises an elongate tubular member 200 disposed to bridge between the head portion 47 and the base portion 49 joining them together axially spaced apart. The tubular member 200 has an inner end 202 and an outer end 204. The inner end 202 of the tubular member 200 is fixedly coupled to the head portion 47 by being formed integrally therewith. The outer end 204 of the tubular member 200 engages the base portion 49. The tubular member 200 is coupled to the head portion 47 and the base portion 49 in a manner so as to not interfere with the engagement of the head disc 48 and a base disc 50 with the side wall 20 of the chamber.

The tubular member 200 has a wall 206 extending between the inner end 202 and the outer end 204. The wall 206 has a radially inwardly directed inner wall surface 208 and a radially outwardly directed outer wall surface 210. The wall 206 has the shape of a solid of revolution rotated about the central axis 22. The wall extends circumferentially entirely about the central axis 22, that is, 360 degrees about the central axis 22. Each of the inner end 202 and the outer end 204 is an annular ring that extends annularly 360 degrees about the central axis 22.

A plurality of openings 212 extend radially through the wall 206 between the inner wall surface 208 and the outer wall surface 210. The openings 212 each have an axial extent. The openings 212 are spaced circumferentially about the tubular member 200 with each opening 212 spaced circumferentially from its adjacent openings 212 by an axially extending web 213. Preferably, as shown, the openings 212 are identical and evenly spaced circumferentially by identical webs 213. Each opening 212 is shown to be defined between an inner end surface 501, an outer end surface 503 and two side surfaces 505 and 507. Each opening 212 is axially elongate and has an axial extent between the inner end surface 501 and the outer end surface 503. Each opening has a circumferential extent between the side surfaces 505 and 507.

In operation of the pump, fluid which moves through the piston 16 radially outwardly of the head disc 48 passes through the openings 212 to reach the outlet 54.

Figure 4:
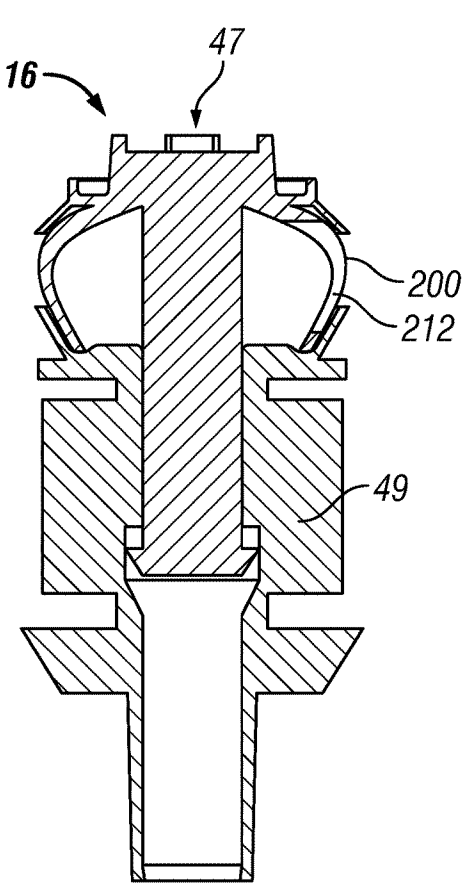
FIG. 4 is a cross-sectional side view of the piston as in FIG. 2 but in a second compressed condition.

The base portion 49 has a stem 46 that carries not only the base disc 50 but also locating webs 66 and an engagement flange 62. The base disc 50 is a circular resilient flexible disc located on the stem 46 spaced axially outwardly from the head disc 48. The base disc 50 extends radially outwardly from the stem 46 to circumferentially engage the chamber wall 20 substantially preventing fluid flow therebetween outwardly in the chamber 18. As with the head disc 48, the base disc 50 is preferably formed as thin resilient disc, in effect, having an elastically deformable edge portion to engage the chamber wall 20. The stem 46 has a central passageway 52 extending along the axis 22 from an inner inlet end 58 located on the stem 46 between the head disc 48 and the base disc 50 to the outlet 54 at the outer end of the head portion 49. The passageway 52 permits fluid communication through the base portion 49 past the base disc 50, between the inlet end 58 and the outlet 54. Locating discs 66 and locating webs 67 best seen in FIG. 4 are provided to engage chamber wall 20 so as to assist in maintaining the base portion 49 axially centered within the chamber 18 when sliding in and out of the chamber 18. The stem 46 comprises a tubular member and can be seen to have the passageway 52 extend therethrough between the outlet 54 and the inlet end 58 with the inlet end 58 open to the chamber 18 between the head disc 48 and the base disc 50.

Each of the base portion 49 and the head portion 47 is circular in any in cross-section normal the axis 22 therethrough. Each of the base portion 49 and the head portion 47 is adapted to be slidably received in chamber 18 coaxially within the chamber 18.

Figure 3:
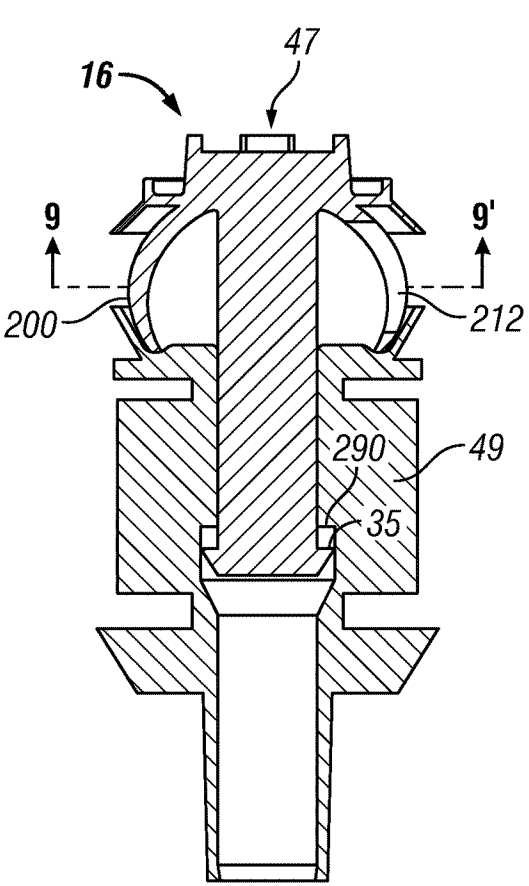
FIG. 3 is a cross-sectional side view of the piston as in FIG. 2 but in a first compressed condition.

As seen in FIG. 3, the passageway 52 has its side wall formed to provide an axially outwardly directed catch surface 290 which forms a hook member to be engaged by the hooking member 34 of the head stem 30 and limit inward axial movement of the head portion 47 relative the base portion 49. The catch surface 290 is provided as a shoulder between an inner portion of the passageway 52 of a first diameter and an outer portion of a larger diameter.

The engagement flange 62 is provided on the stem 46 for engagement to move the base portion 49 inwardly and outwardly. The engagement flange 62 may also serve the function of a stopping disc to limit axial inward movement of the piston 16 by engagement with the outer end 23 of the body 12. The stem 46 is shown to extend outwardly from the engagement flange 62 to the discharge outlet 54 as a relatively narrow hollow tube 138 with the passageway 52 coaxially therethrough.

The one-way valve 14 comprises a unitary piece of resilient material having a resilient, flexible, annular rim 132 for engagement with the side wall of the chamber 18. The one-way valve is integrally formed with a shouldering button 134 which is secured in a snap-fit inside an opening 136 in a central upper end of the chamber 18.

As seen in FIG. 1, an annular inner compartment 111 is formed inside the chamber 18 between the one-way valve 14 and the head disc 48 and an annular outer compartment 112 is formed inside the chamber 18 between the head disc 48 and the base disc 50. The volume of the annular outer compartment 112 varies with variance of the length of the variable length intermediate portion 45 of the piston 16.

The body 12 carries an outer cylindrical portion 40 carrying threads 130 to cooperate with threads formed on the threaded neck 34 of the container 26.

In use, the pump is preferably orientated such that such that the outlet 54 is directed downwardly, however this is not necessary.

Figure 2:
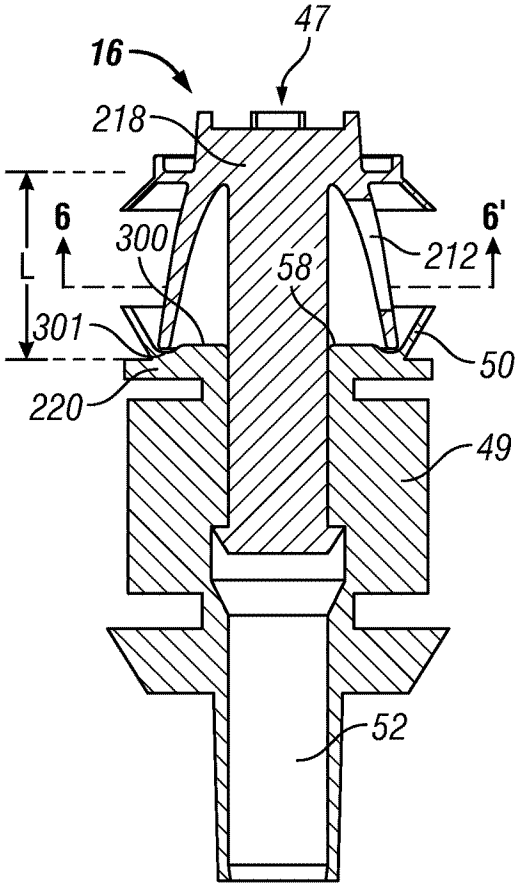
FIG. 2 is a cross-sectional side view of the piston of the pump shown in FIG. 1 in the same uncompressed condition as in FIGS. 1 and 2.

The tubular member 200 has an inherent resiliency by reason of being formed from a suitable resilient material, preferably plastic material. The inherent resiliency of the tubular member 200 biases the tubular member 200 to adopt an unbiased configuration of a maximum axial length measured along the central axis. When the tubular member 200 is subjected to axially directed compression forces the tubular member 200 compresses axially such that its axial length as measured along the central axis 22 reduces and when such compressive forces are released, the tubular member 200 increases in length expanding towards the unbiased condition. FIG. 2 shows the piston 16 assembled in an uncompressed condition. FIG. 3 shows the piston 16 in a first compressed condition in which the variable length intermediate portion 45 and its tubular member 30 are compressed to be of reduced axial length compared to FIG. 2.

The tubular member 200 is disposed about the central axis 22 bridging between the head portion 47 and the base portion 49 and acts in the manner of a spring to urge the head portion 47 and base portion 49 axially apart.

The inner end 202 of the tubular member 200 is fixed to the head stem 43 radially inwardly from the head disc 48 by being formed integrally therewith. The base portion 49 is arranged such that the outer end 204 of the tubular member 200 engages the stem 46 of the base portion 49 radially inwardly from the base disc 50.

As shown in FIG. 2, the base portion 49 provides an axially inwardly directed surface 30 at its inner end between the inner inlet end 58 of the passageway 54 and the base disc 50 which surface 300 is to be engaged by the outer end 204 of the tubular member 200. In the first embodiment, an annular groove 301 is provided in the surface 300 open axially inwardly within which groove 301 the outer end 204 of the tubular member 200 is seated. Engagement between the annular groove 301 and the outer end 204 of the tubular member 200 assists in maintaining the tubular member 200 coaxially disposed about the central axis 22. As shown, the groove 301 preferably has an outer side surface which is directed radially inwardly to engage the outer surface 210 of the wall of the tubular member 200. The groove 301 also has an inner side surface directed radially outwardly and adapted to engage the inner surface 208 of the wall of the tubular member 200. The groove 301 could be configured to provide merely the outer side or the inner side surface and still function to restrain the outer end of the tubular member 200.

The variable length intermediate portion 45 has an axial length defined as a length measured along the central axis 22 as between the head disc 48 and the base disc 50. This axial length is measured along the axis 22 between a center 218 on the head portion 47 and a center 220 of the base portion 49. The axial length is indicated as L on FIG. 2 and is variable between a maximum length and a minimum length due to the ability of the elongate members 200 to deflect.

The piston 16 shown in each of FIGS. 5 and 6 show the piston 16 in an uncompressed condition of FIG. 2. In contrast, FIGS. 7 to 10 show the piston 16 in the compressed condition of FIG. 3.

Figure 11:
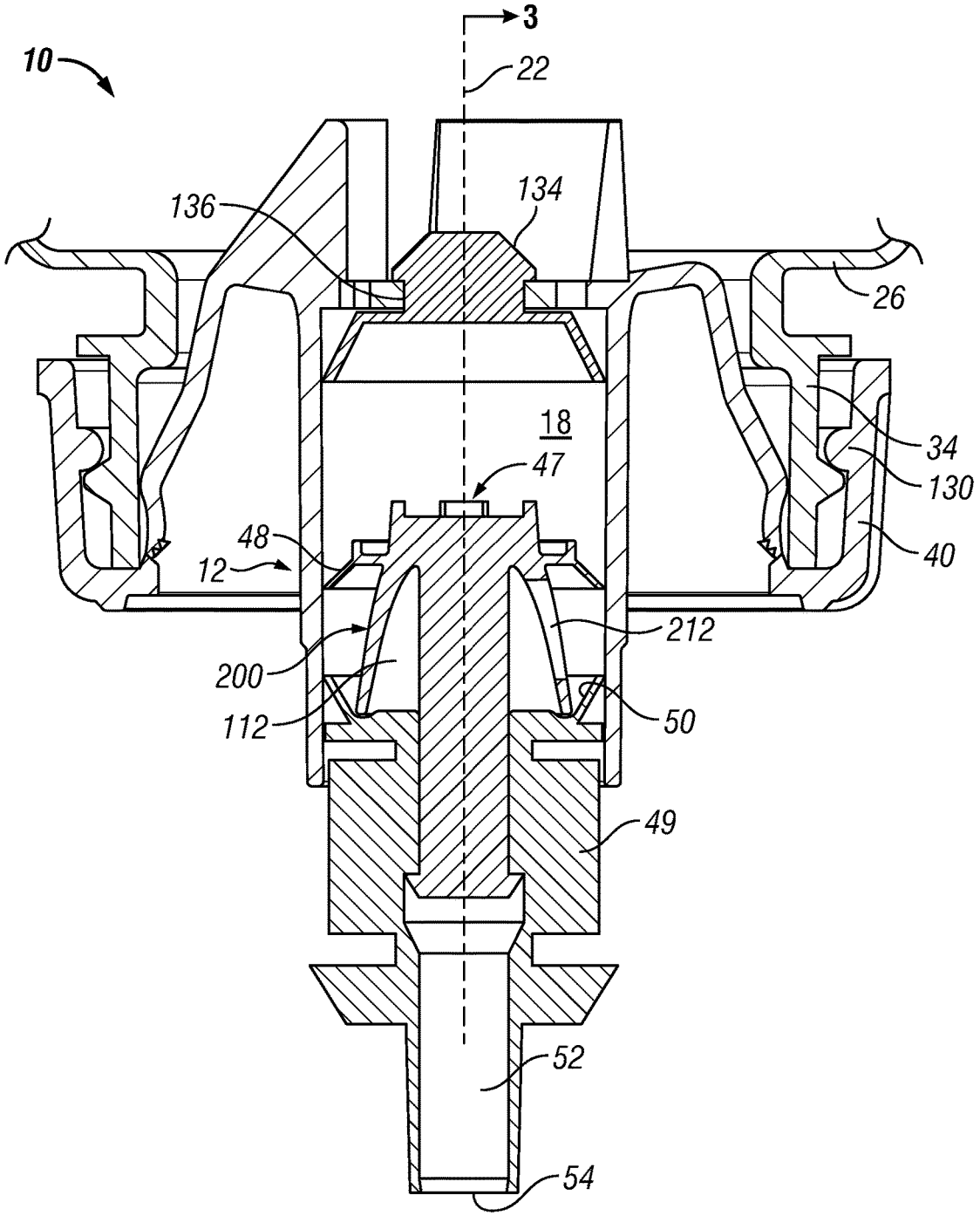
FIGS. 11, 12, 13 and 14 are cross-sectional views of the pump of FIG. 1, respectively, with in FIG. 11 the piston in an extended position and in the uncompressed condition of FIG. 2, with in FIG. 12 the piston in an extended position and in the compressed condition of FIG. 3, with in FIG. 13 the piston in a retracted position and in the compressed condition of FIG. 3; and with in FIG. 14 the piston in a retracted position and in the uncompressed condition of FIG. 2.
Figure 12:
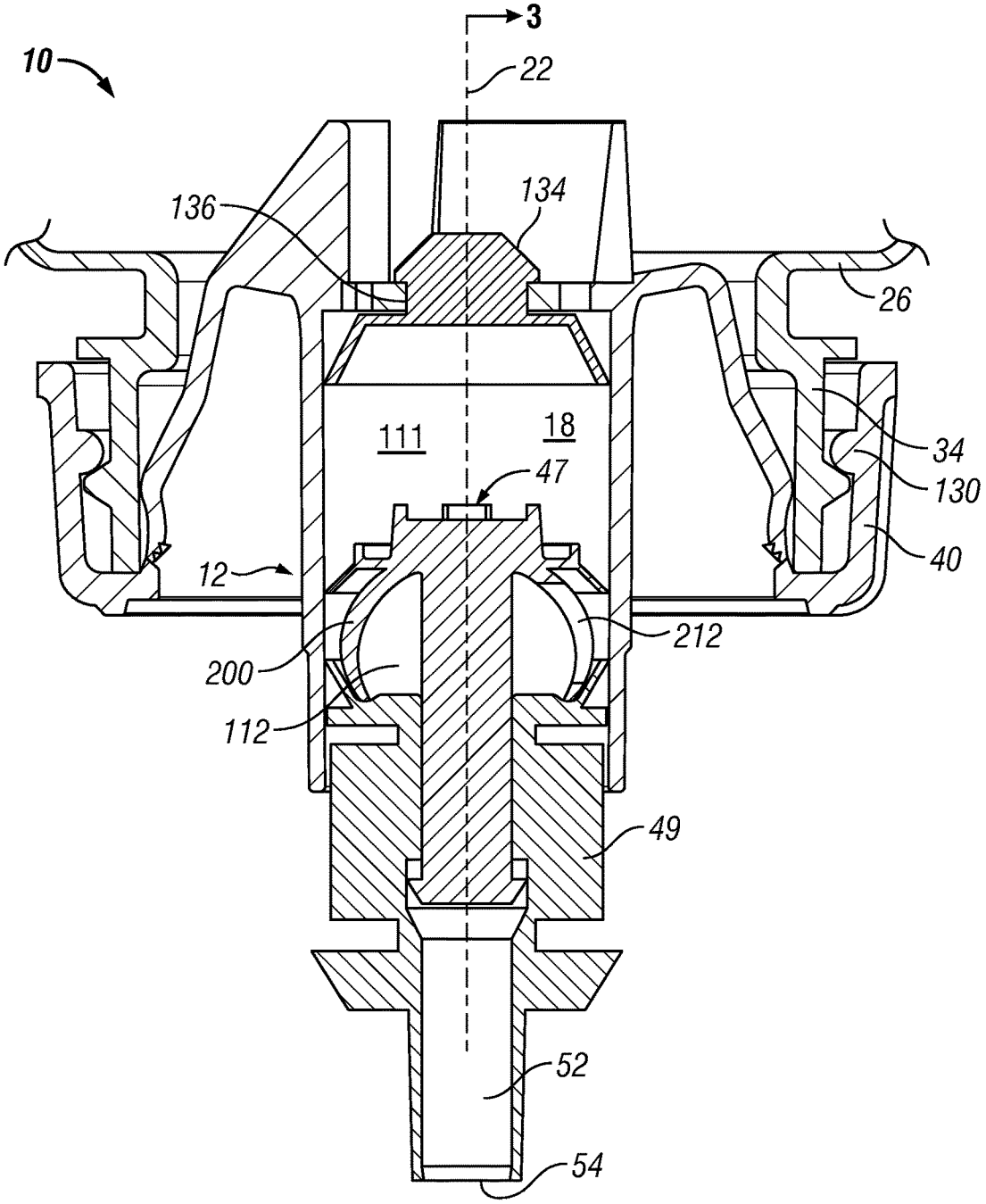
Figure 13:
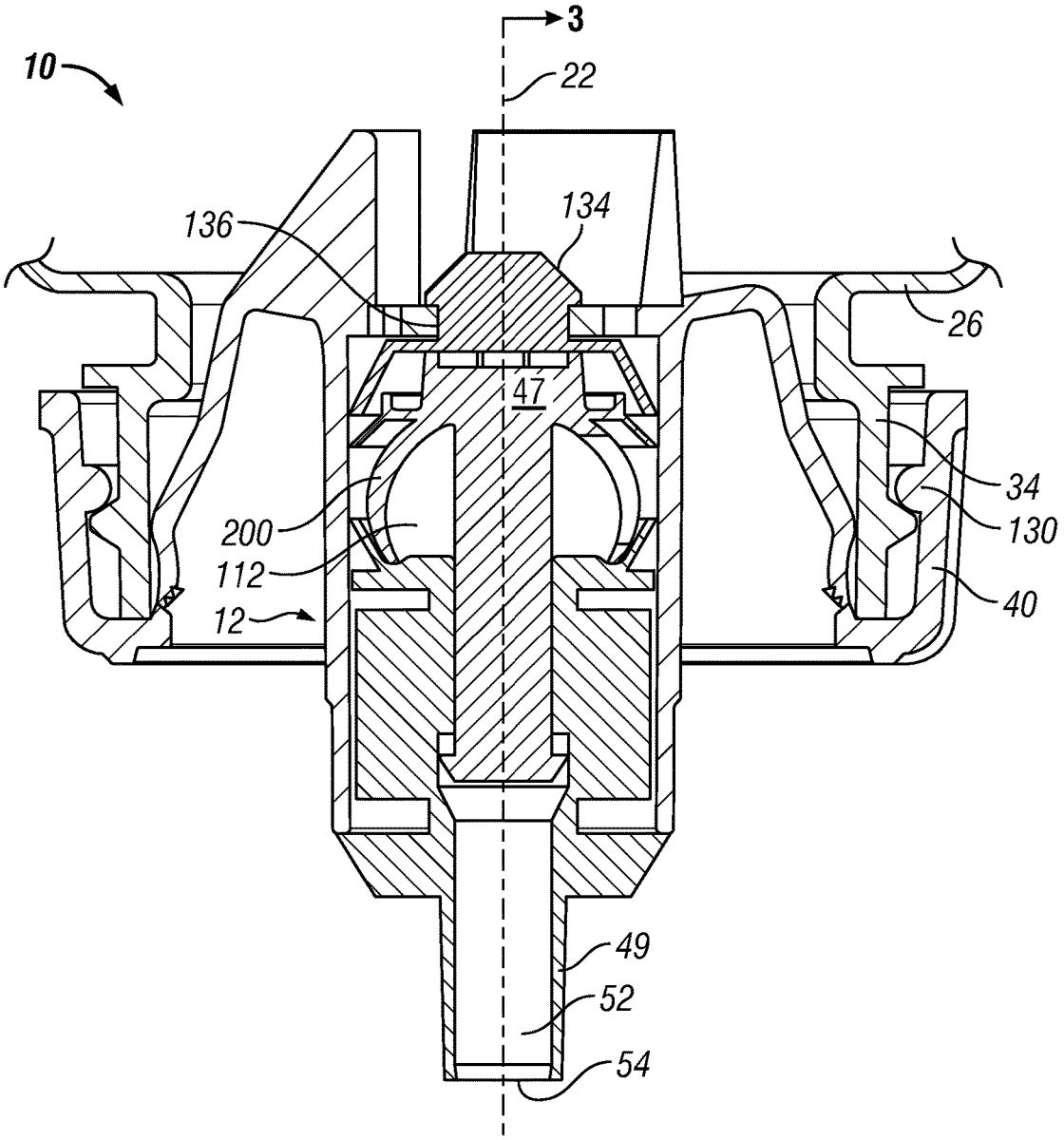
Figure 14:
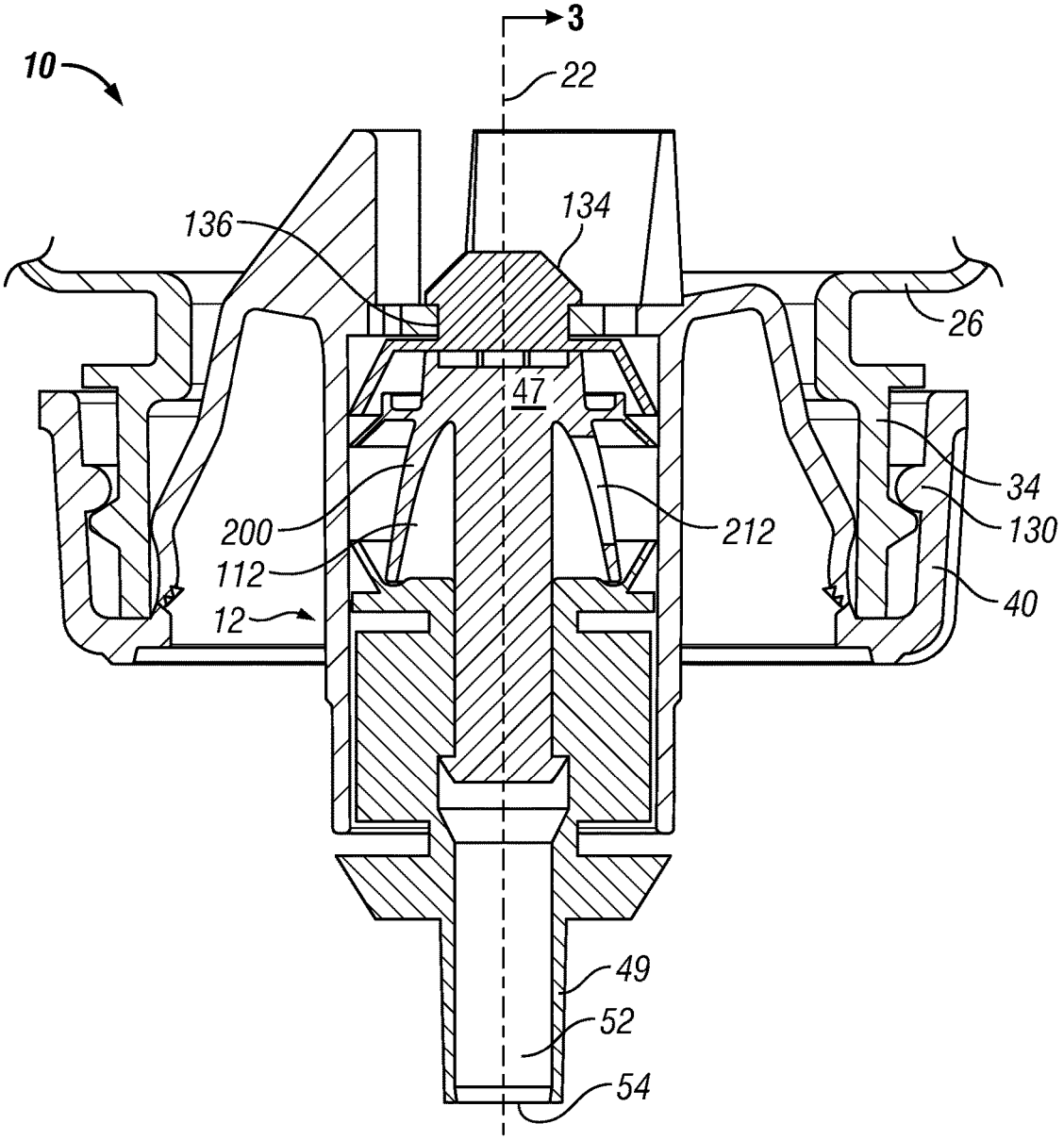

The pump 10 is shown in FIGS. 12, 13 and 14 in use in a cycle of operation of the pump. FIGS. 11 and 14 show the piston 16 within the chamber 18 of the body 12 in an uncompressed condition or also sometimes referred to herein as an expanded condition as seen in FIG. 2 in which the variable length intermediate portion 45 is in its maximum length. With movement of the base portion 49 outwardly in the chamber 18, resistance to movement of the head portion 47 and particularly its head disc 48 within the chamber 18 will give rise to tension forces being applied across the tubular member 200. The response of the tubular member 200 to such tension force will depend upon the nature and resiliency of the tubular member 200 and the amount of the tension force.

FIGS. 12 and 13 show the piston 16 received in the chamber 18 of the body 12 with the variable length intermediate portion 45 in a "compressed condition" as seen in FIG. 3. With movement of the base portion 49 inwardly in the chamber 18, resistance to inward movement of the head portion 47 and notably resistance to movement of the head disc 48 inwardly in the chamber 18 results in compressive forces being applied to the variable length intermediate portion 45 between the base portion 49 and the head portion 47. Such compressive forces cause the tubular member 200 to deflect to reduce the axial length of the variable length intermediate portion 45 to the reduced length compressed condition as seen in FIGS. 12 and 13.

In operation of the pump, the relative tension forces and compression forces which may be applied through the variable length intermediate portion 45 between the base portion 49 and the head portion 47 will cause the variable length intermediate portion 45 to adopt configurations between an expanded condition and a compressed condition. The relative resistance of the head portion 47 to sliding within the chamber 18 is affected by many factors including the friction to movement of the disc portion 47 within the chamber 18, inwardly and outwardly, the nature of the fluid in the reservoir having regard to, for example, its viscosity, the temperature, the speed with which the base portion 49 is moved and various other features which will be apparent to a person skilled in the art. A person skilled in the art by simple experimentation can determine suitable configurations for the intermediate member 45 so as to provide for the axial length of the variable length portion to vary between a suitable minimum length and a suitable maximum length in cyclical movement of the piston 16 in a cycle of operation.

The outer wall surface 208 of the wall 206 of the tubular member 200 as seen in side view in FIG. 2 in the uncompressed condition is convex, that is, the outer wall surface 208 bows radially outwardly.

As the tubular member 200 is axially compressed to the reduced length compressed condition of FIG. 3, the convexity of the outer wall surface 210 increases. As seen in FIG. 3, when in the compressed condition, the outer wall surface 210 is convex, however, bowed outwardly to an extent greater than in the uncompressed condition of FIG. 2.

The openings 212 are provided through the wall 206 such that the openings change in relative shape with axial deflection of the tubular member 200. Each opening 212 provides a passage through which fluid may flow through the wall 206. In any condition of the wall 206, each passage has a minimum cross-sectional area for fluid flow therebetween. The cross-sectional area of the passage through openings 212 for fluid flow therethrough preferably increases as the tubular member 200 is deflected axially from the expanded condition to the compressed condition by reason of the circumferential extent of each opening between the side surfaces 505 and 507 increasing as the wall 206 bows out and the outer wall surface 210 increases in convexity. While not necessary, having the cross-sectional area of the passage through each opening increase as the tubular member 200 is compressed is advantageous since during operation of the pump, a larger volumetric fluid flow through the tubular member 200 is required when the tubular member 200 is compressed.

Figure 10:
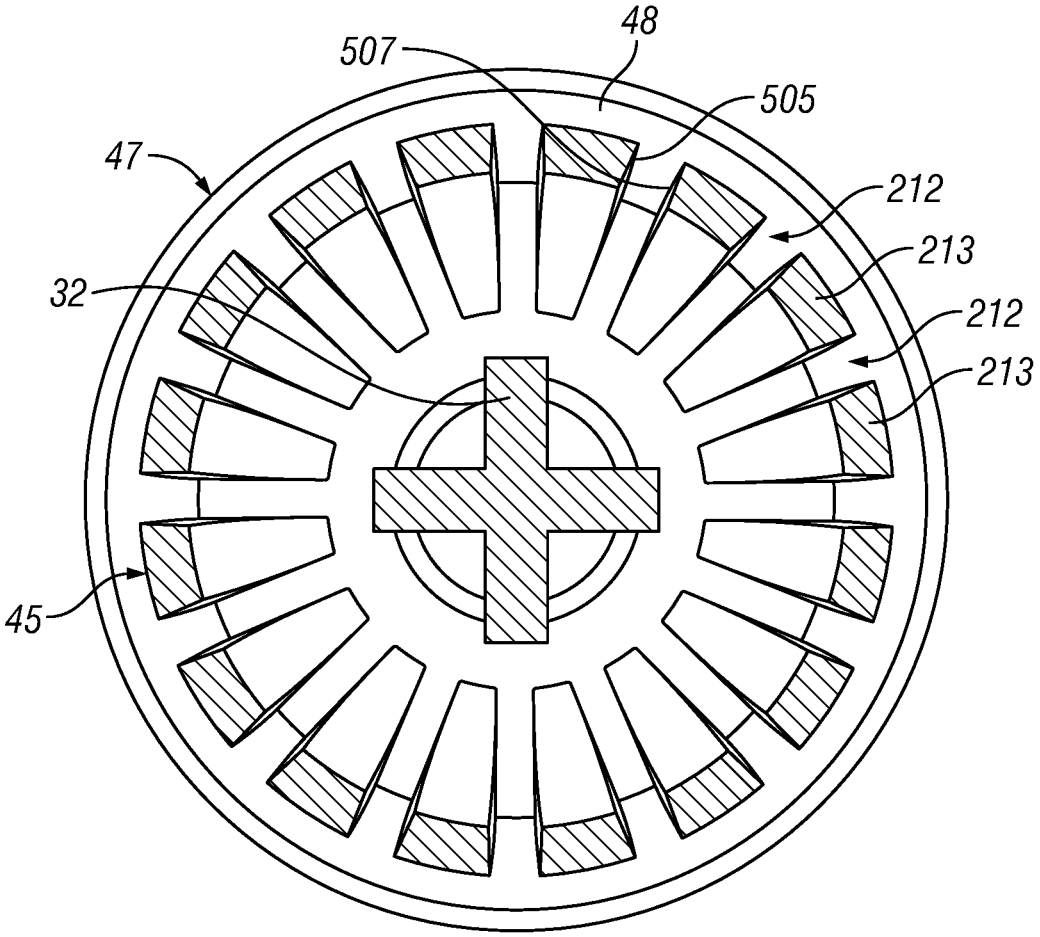
FIG. 10 is a cross-sectional end view of the piston of FIG. 3 along section line 9-9' in FIG. 3.

Reference is made to FIG. 6 which shows a cross-sectional end view through the piston 16 in the uncompressed condition of FIG. 2 in which the openings 212 are shown in end cross-section disposed between the webs 213. Reference is made to FIG. 10 which shows a similar cross-sectional end view as in FIG. 6, however, with the piston 16 in a compressed condition of FIG. 3 in which the tubular member 200 is axially compressed compared to FIG. 2. As may be seen by a comparison of FIG. 6 with FIG. 10, the webs 213 in FIG. 10 are located radially farther outwardly from the central axis 22 with a result that the circumferential extent of each opening 212 has been increased by reason that side surfaces 505 and 507 defining each opening 212 are circumferentially farther apart in FIG. 10 than in FIG. 6. The cross-sectional area for fluid flow through each opening is a function of the circumferential extent of the opening. Generally, with an increase in circumferential extent, the cross-sectional area of the opening increases.

The pump operates in a cycle of operation in which the piston 16 is reciprocally moved relative the body 12 inwardly in a retraction stroke and outwardly in a withdrawal stroke.

During movement of the head portion 49 inwardly into the chamber, since fluid is prevented from flowing outwardly past the disc 50, pressure is created in the inner compartment 111 formed in the chamber 18 between the head disc 48 and the one-way valve 14. This pressure urges rim 132 of the one way valve 14 radially inwardly to a closed position abutting the chamber wall 20. As a result of this pressure, head disc 48 deflects at its periphery so as to come out of sealing engagement with the chamber wall 20 and permits fluid to flow outwardly past head disc 48 into the annular outer compartment 112 between the head disc 48 and the sealing disc 50 through the tubular member 200 via the openings 212 and hence out of chamber 18 via the passageway 52.

During a withdrawal stroke in which the piston 16 is moved outwardly from the chamber 18, the withdrawal of the piston causes the one-way valve 14 to open with fluid to flow past annular rim 132 which is deflected radially inwardly into the inner compartment 111 in the chamber 18. In the withdrawal stroke, head disc 48 remains substantially undeflected and assists in creating a vacuum in the inner compartment 111 to deflect rim 132 and draw fluid past rim 132.

The head disc 48, on one hand, substantially prevents flow inwardly therepast in the withdrawal stroke and, on the other hand, deforms to permit flow outwardly therepast in the retraction stroke. The head disc 48 shown facilitates this by being formed as a thin resilient disc, in effect, having an elastically deformable edge portion near chamber wall 20.

When not deformed, head disc 48 abuts the chamber wall 20 to form a substantially fluid impermeable seal. When deformed, as by its edge portion being bent away from wall 20, fluid may flow outwardly past the head disc. Head disc 48 is deformed when the pressure differential across it, that is, when the pressure on the upstream side is greater in the inner compartment 111 than the pressure on the downstream side in the outer compartment 112 by an amount greater than the maximum pressure differential which the edge portion of the head disc can withstand without deflecting. When this pressure differential is sufficiently large, the edge portion of the head disc deforms and fluid flows outwardly therepast. When the pressure differential reduces to less than a given pressure differential, the head disc returns to its original inherent shape substantially forming a seal with the wall 20.

FIGS. 11 to 14 show different conditions the variable length intermediate portion 45 assumes in a cycle of operation. In this cycle of operation, the base portion 49 is moved in a retraction stroke from an extended position as seen in FIG. 11 to a retracted position as seen in FIG. 13. In a withdrawal stroke, the base portion 49 is moved from the retracted position of FIG. 13 to the extended position shown in FIG. 11.

FIG. 11 illustrates the piston 16 with the base portion 49 in the extended position and the variable length intermediate portion 45 in an uncompressed condition. In the extended position and uncompressed condition of FIG. 11, the outer compartment 112 formed in the chamber 18 between the head disc 48 and base disc 49 is at a maximum volume. From FIG. 11, the base portion 49 is moved inwardly in a retraction stroke to assume the condition of FIG. 12 in which the variable length intermediate portion 45 is a compressed condition. On the base portion 49 moving inwardly in the chamber 18 from the position of FIG. 11, while the length of the variable length intermediate portion 45 is greater than its minimum length, resistance to movement of the head portion 47 and its head disc 48 inwardly in the chamber 18 is sufficient that the length of the variable length intermediate portion 45 decreases toward its minimum length as shown in FIG. 12 before the head portion 47 is moved inwardly in the chamber 18. Thus, in movement of the base portion 49 inwardly from the position of FIG. 11, compressive forces will be applied to the variable length intermediate portion 45 which forces will reduce the length of the variable length intermediate portion 45 until the compressive forces transferred by the variable length intermediate portion 45 are greater than the resistance to movement of the head portion 47 inwardly in the chamber. The compressive forces may be developed such that the variable length intermediate portion substantially decreases to its minimum length before the head portion 47 is substantially moved inwardly.

From the position shown in FIG. 12, with the variable length portion in the compressed condition, further inward movement of the base portion 49 in the retraction stroke moves the piston 16 with the variable length portion maintained in the compressed condition inwardly to the position of FIG. 13 in which the base portion 49 is fully retracted and the variable length intermediate portion 45 is compressed. FIG. 13 thus represents a retracted position and compressed condition of the piston 16.

From the position of FIG. 13, in a withdrawal stroke, the base portion 49 is moved outwardly in the chamber. In movement of the base portion 49 from the position of FIG. 13 to the position of FIG. 14, while the length of the variable length intermediate portion 45 is less than the maximum length, resistance to movement of the head portion 47 and therefore its head disc 48 outwardly in the chamber 18 is sufficient that the length of the variable length intermediate portion 45 increases toward the maximum length before the head portion is moved outwardly in the chamber 18. In this regard, in moving from the position of FIG. 13 to the position of FIG. 14, outward movement of the base portion 49 applies tension forces to the variable length intermediate portion 45. These tension forces will act on the variable length intermediate portion 45 expanding the variable length portion 45 until such time as the tension forces which are transferred by the variable length intermediate portion 45 from the base portion 49 the head portion 47 are greater than the resistance of the head portion for movement outwardly in the chamber. The tension forces may be developed such that the variable length intermediate portion 45 substantially increases to its maximum length before the head portion 47 is substantially moved outwardly.

From the position of FIG. 14, the withdrawal stroke is complete by movement to the position of FIG. 11. In moving from the position of FIG. 14 to the position of FIG. 11, the variable length intermediate portion 45 is maintained in the expanded condition with the variable length intermediate portion 45 at its maximum length and tension forces caused by movement of the base portion 49 are transferred via the variable length intermediate portion 45 to the head portion 47.

In a cycle of operation in moving from the position of FIG. 12 to the position of FIG. 13, the volume of the inner compartment 111 reduces and hence fluid is discharged from the inner compartment 111 past the head disc 48, through the tubular member 200 via the openings 212 through the passageway 52 out the outlet 54 since fluid within the chamber 18 is prevented from passing inwardly past the one way valve 14 and is prevented from passing outwardly past the base disc 50. In moving from the position of FIG. 11 to the position of FIG. 13, pressure is created within the inner compartment 111 which closes the one-way valve 14. Fluid within the inner compartment 111 becomes compressed by movement of the head disc 48 inwardly. Such pressure causes the deformable edge portion of the head disc 48 to deflect away from the chamber wall 18 thus permitting flow of fluid from the inner compartment 111 into the outer compartment 112. Since the volume of the outer compartment 112 remains the same in the compressed condition, any fluid which is passed outwardly past the head disc 48 causes fluid within the outer compartment 112 to be dispensed through the tubular member 200 via the openings 212 and through the passageway 52 out from the outlet 54.

In movement from the position of FIG. 13 to the position of FIG. 14, the volume of the outer compartment 112 increases. This increase in volume of the outer compartment 112 causes a drawback of fluid in the passageway 52 from the outlet 54 back into the outer compartment 112 with some fluid moving inwardly through the tubular member via the openings 212. This drawback may not only be a drawback of fluid in the passageway 52 but also possibly of any air existing in the passageway 52.

To facilitate drawback of fluid, the relative nature of the head disc 48 and the base disc 50 and the engagement of each with the chamber wall 20 are preferably selected such that vacuum created within the outer compartment 112 will drawback fluid from the passageway 52 rather than deflect the head disc 48 to draw liquid from the inner compartment 111 past the head disc 48 into the outer compartment 112, or, deflect the base disc 50 to draw atmospheric air between the base disc 50 and the chamber wall 20.

In movement from the position of FIG. 14 to the position of FIG. 11, the volume in the outer compartment 112 is maintained substantially constant with the variable length portion 45 in a maximum length condition, however, movement of the head disc 48 outwardly increases the volume in the inner compartment 111 thus drawing fluid from the reservoir inwardly past the one-way valve 14 into the inner compartment 111.

The drawback pump in accordance with the present invention may be used in manually operated dispensers such as those in which, for example, the piston 16 is moved manually as by a user engaging an actuator such as a lever which urges the piston 16 either outwardly or inwardly. The drawback pump can also be used in automated systems in which a user will activate an automated mechanism to move the piston in a cycle of operation.

A preferred arrangement for operation of the drawback pump in accordance with the present invention is for the pump to assume a position between the condition shown in FIG. 14 and the condition shown in FIG. 11 as a rest position between cycles of operation. For example, in the context of a manual dispenser, the dispenser may be arranged such that the base portion 49 is biased to assume as a rest position between cycles of operation, the extended position seen in FIG. 11. A person would manually operate a lever to move the dispenser from the position of FIG. 11 to the position of FIG. 13. On release of the lever, a spring will return the lever and base portion 48 to the position of FIG. 11. In such a cycle of operation, on movement from the position of FIG. 11 to the position of FIG. 13, fluid is dispensed from the outlet 54. In a return stroke, for example, due to the bias of a spring (not shown), fluid in the passageway 52 is withdrawn in movement from the position of FIG. 13 to the position of FIG. 14 and the inner compartment 111 is filled in movement of the piston to the rest position of FIG. 11. In automated operation, a rest position between cycles may be at some point in between the position of FIG. 14 and the position of FIG. 11.

The preferred embodiment illustrates the piston head portion 47 and intermediate portion 45 as being formed from a unitary piece of plastic preferably by injection molding. It is to be appreciated that a similar structure could be formed with each of the head portion 47, base portion 49 and intermediate portion 45 being separately formed. Also the variable length portion could be formed together with either or both of the head portion and the disc portion as a unitary piece of plastic.

In the context of the embodiment of FIGS. 1 to 14, preferably the tubular member 200 has an inherent unbiased condition when molded.

An assembled piston 16 will have an inherent unbiased condition as seen in FIG. 2 which it will assume when no axial forces are applied to it. The inherent unbiased condition of the piston 16 depends on the inherent unbiased condition of the head portion 47, the base portion 49 and the intermediate portion 45. In the preferred embodiment, effectively only the tubular member 200 is axially deformable.

In the preferred embodiment of FIGS. 1 to 14, when the piston 16 is in the unbiased inherent condition, the tubular member 200 is either in its unbiased inherent condition or slightly compressed from its unbiased inherent condition. In FIG. 2, if the tubular member 200 is in its unbiased inherent condition, then the axial length between the outer end 204 of the tubular member 200 and the catching surface 35 on the head stem 30 is equal to the axial length between the groove 301 on the base portion 49 and the catch surface 209 on the base portion 49.

In FIG. 2, if the tubular member 200 is in a condition compressed from its unbiased inherent condition, then the axial length between the outer end 204 of the tubular member 200 and the catching surface 35 on the head stem 30 is less than the axial length between the groove 301 on the base portion 49 and the catch surface 209 on the base portion 49.

The tubular member 200 is axially compressible from the inherent unbiased condition to assume conditions in which its axial length is reduced compared to the inherent unbiased condition. When deformed to a reduced length condition and released, the tubular member returns to its inherent unbiased condition. Depending on the configuration of the tubular member 200 in the inherent unbiased condition, the tubular member can also be axially expandable from the inherent unbiased condition to a stretched position in which its axial length is increased compared to the inherent unbiased condition. For example, if the wall of the tubular member is in the inherent unbiased condition, not straight but bowed, then on applying axial tension forces, the wall may be deformed against its bias to become straight increasing the axial length. As another example, if the wall of the tubular member is straight in the inherent unbiased condition, for example, frustoconical, then the tubular member cannot be stretched and has its maximum axial length as the inherent unbiased condition. When the piston 16 in its unbiased inherent condition, having the tubular member 200 compressed has the advantage that the inherent bias of the tubular member 200 will assist in ensuring that the outer end 204 of the tubular member 200 is maintained and urged into engagement with the groove 301.

The tubular member 200 is selected so as to provide the head portion 47 and its head disc 48 maintained coaxially arranged within the chamber.

The preferred embodiment of FIG. 1 illustrates a four-piece pump having as the four pieces, the body 12, the one-way valve 14 and the two-piece piston 16, and in which the chamber 18 in the body 12 has a constant diameter. The invention of the present application is also adaptable for use with two piece pumps having a stepped chamber. Such pumps have been disclosed in U.S. Pat. No. 5,676,277 to Ophardt, issued Oct. 14, 1997, the disclosure of which is incorporated herein by reference.

Figure 15:
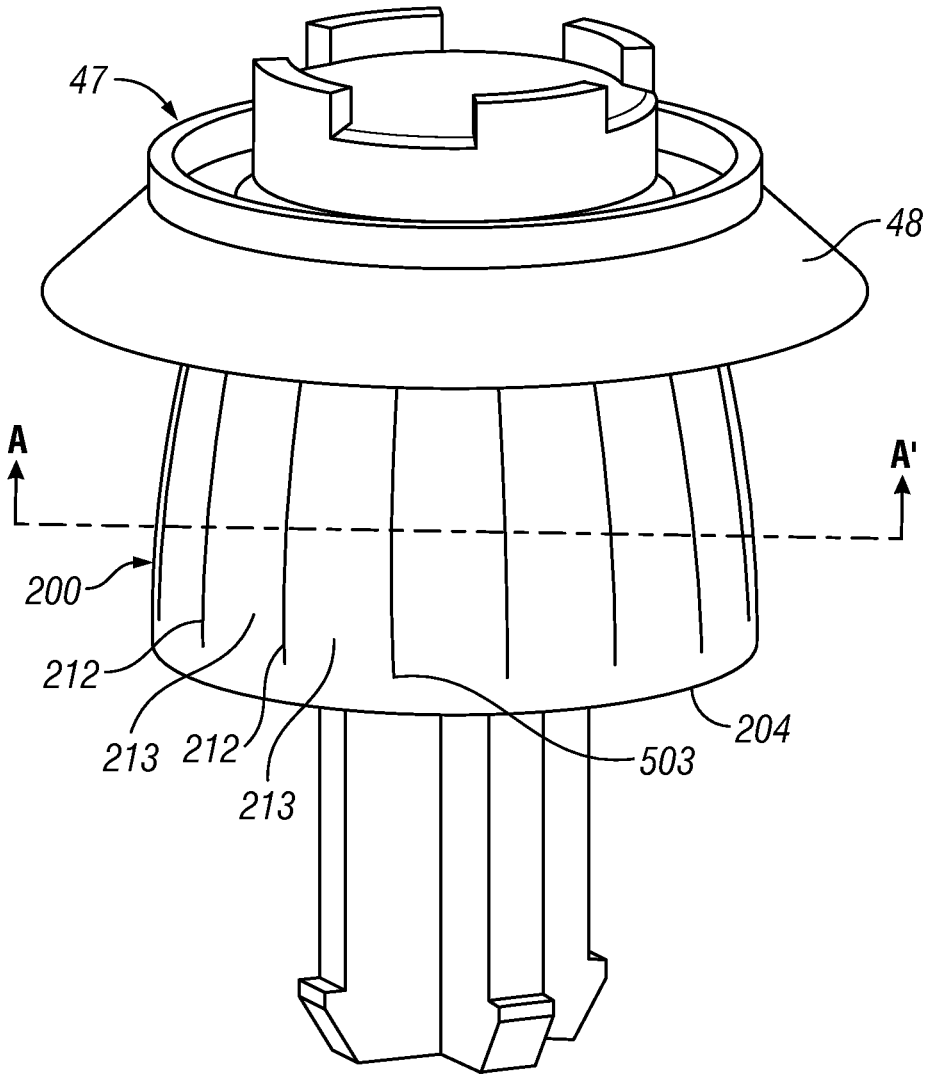
FIG. 15 is a pictorial view similar to FIG. 5 but of a second embodiment of a head portion adapted for substitution for the head portion in FIG. 5 and showing the head portion in an uncompressed condition.
Figure 16:
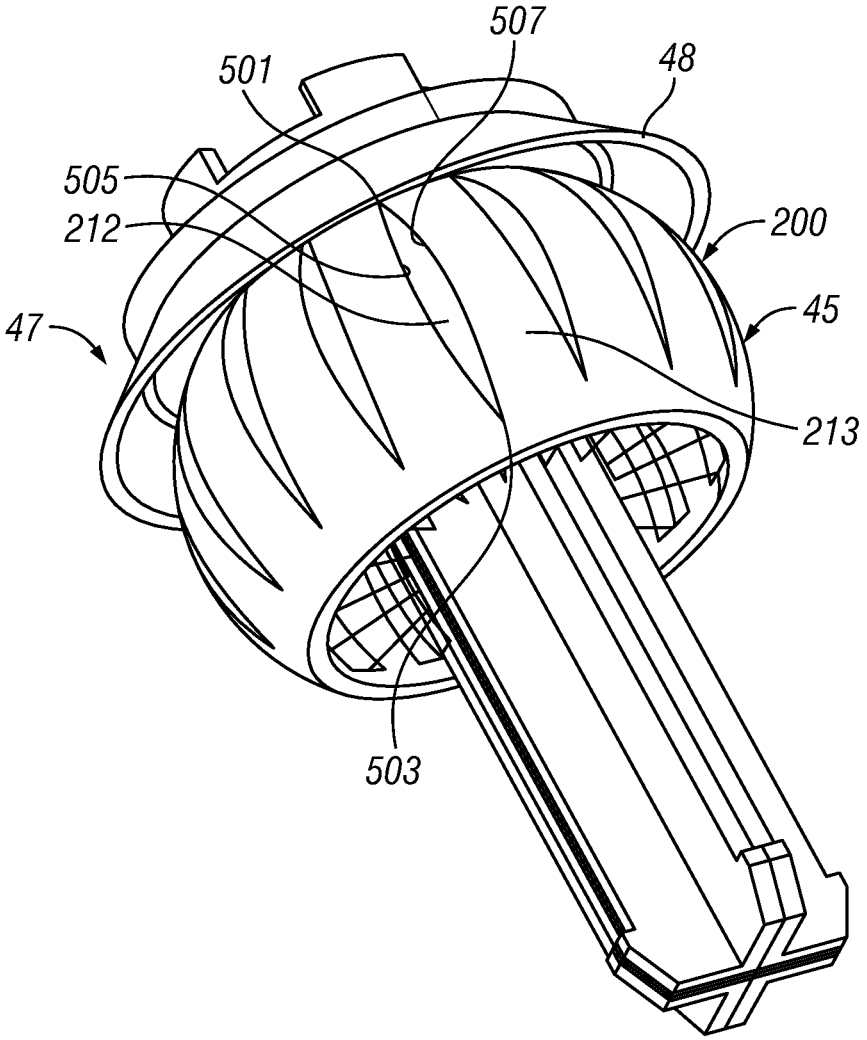
FIG. 16 is a pictorial view of the head portion of FIG. 15 in a compressed condition.
Figure 17:
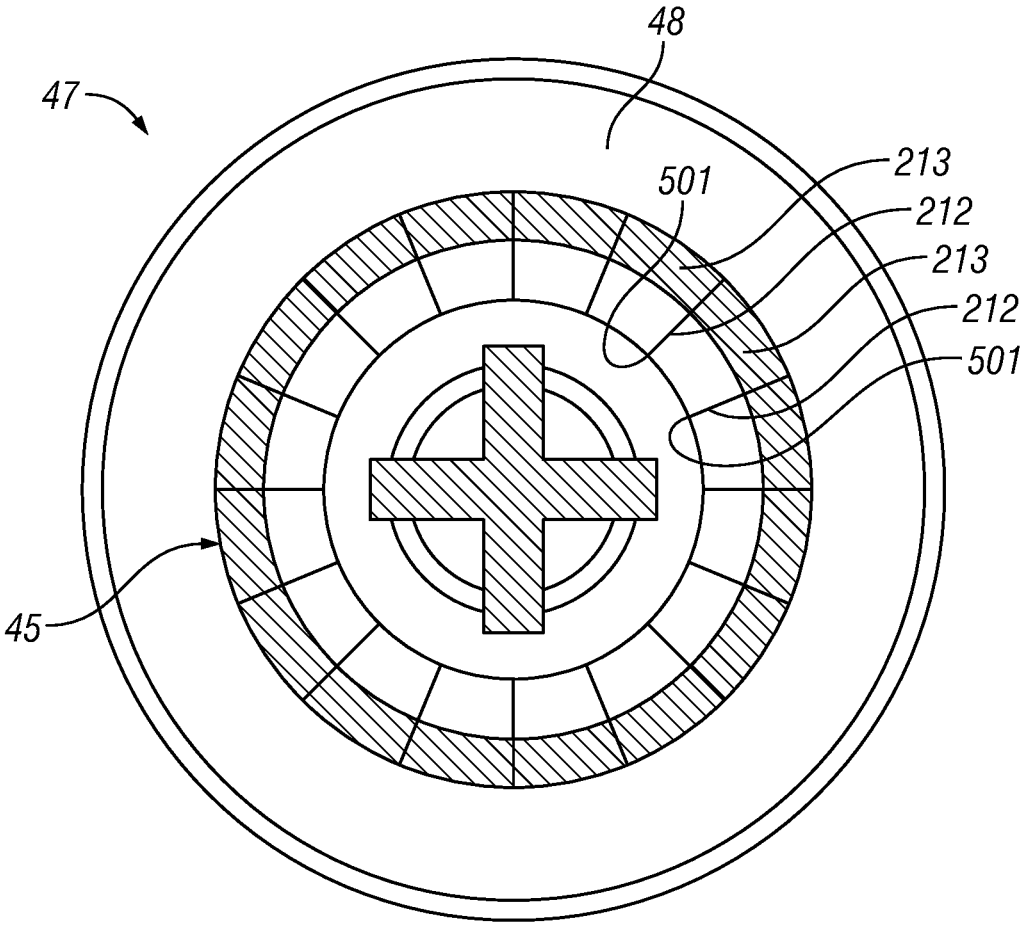
FIG. 17 is a cross-sectional end view similar to FIG. 6 but of the head portion of the piston of FIG. 15 along section line A-A' in FIG. 15.

Reference is made to FIGS. 15 to 17 showing a second embodiment in which an inner piston part 512 comprising a head portion 47 and a variable length intermediate tubular portion 45 is adapted for use with a base portion 49 identical to that shown, for example, in FIG. 1 with the first embodiment. In the second embodiment of FIGS. 15 to 17, the only difference over the first embodiment of FIGS. 1 to 14 is the configuration of the openings 212. As can be seen in FIGS. 15 and 16, each of the side surfaces 507 and 509 which define the openings 212 therebetween converge at a common inner point 501 and at a common outer point 503. FIG. 15 illustrates a condition in which the axial length of the tubular member 200 is greater than the axial length of the tubular member 200 in FIG. 16.

As can be seen in FIG. 15, each of the side surfaces 503 and 507 abut each other so as to close the openings 212 to prevent fluid flow therethrough. With the reduction in the axial length of the tubular member 200 from the position of FIG. 15 to the position of FIG. 16, the concavity of the outer surface of the tubular member 200 increases and the side surfaces 505 and 507 come to have the circumferential extent to which they are spaced increase such that the openings 212 become of increased cross-sectional area. Thus, whereas in FIG. 15 a passage is formed through each opening 212 of a given minimal cross-sectional area, in FIG. 13, the cross-sectional through any passage is reduced to zero as best seen in FIG. 17 in cross-section.

The second embodiment illustrated in FIGS. 15 to 17 may be manufactured in a number of ways. As one method, the wall of the tubular member could be made initially without any openings 212 therethrough, and thereafter axially extending slots may be cut through the wall at each place where an opening 212 is desired. Each slit that is cut preferably would extend in a flat plane which includes a central axis 22 and extends radially outwardly therefrom through the wall. Where the slits are cut in an unbiased condition of the tubular member 200, the openings 212 would be closed. Adopting the piston 16 with an arrangement in which the piston is in an unbiased condition when the tubular member 200 is in an unbiased condition would result in the openings being closed when the piston is in the unbiased condition.

Figure 18:
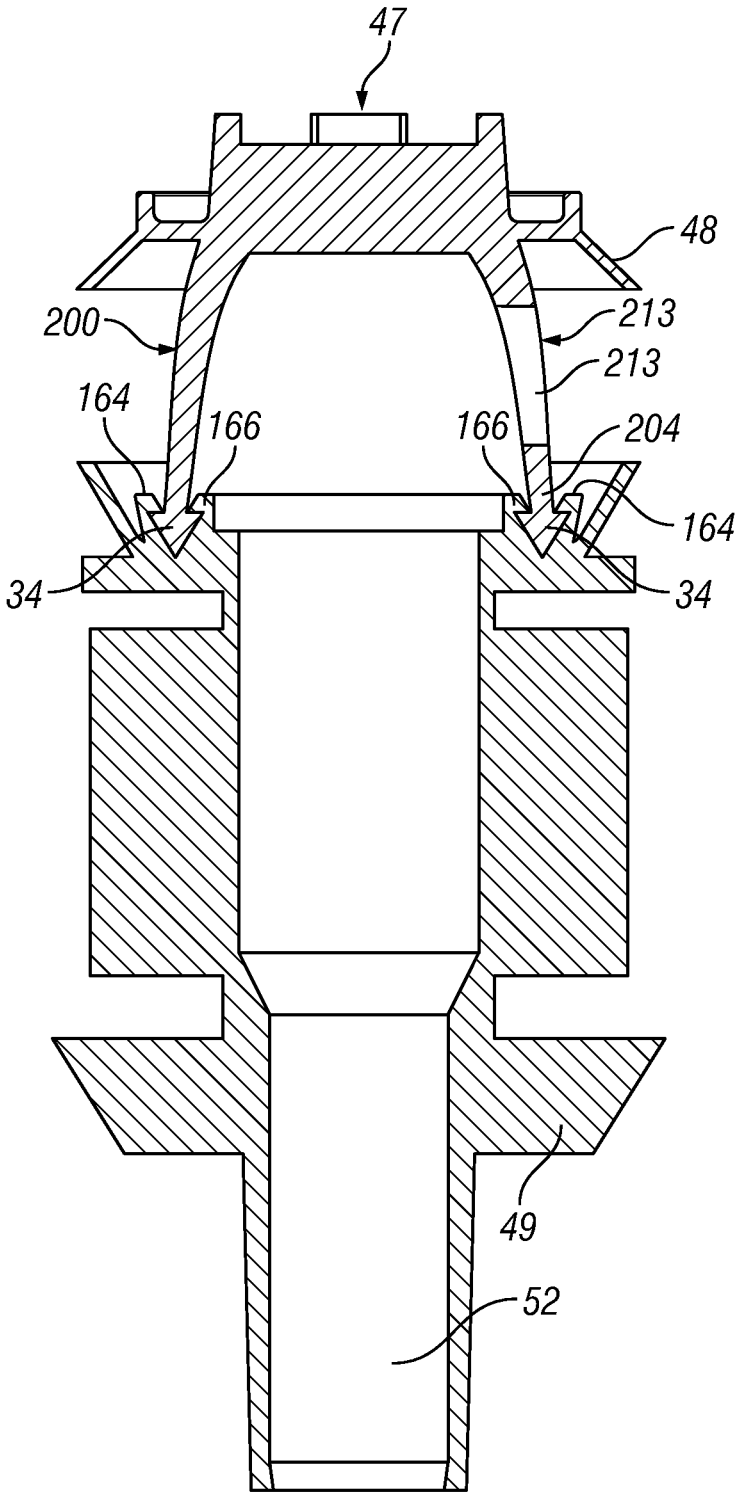
FIG. 18 is a cross-sectional side view similar to FIG. 2 but of a third embodiment of a piston adapted for substitution for the piston in FIG. 1 and with the piston in an uncompressed condition.

Reference is made to FIG. 18 which shows a fourth embodiment of a piston pump in accordance with the present invention. The fourth embodiment of FIG. 18 is substantially identical to the first embodiment of FIG. 2 with a first exception that the head stem 30 from the first embodiment has been removed and with a hooking member 34 is carried on the annular outer end 204 of the tubular member 200. The hooking member 34 is arrow head shaped and has axially inwardly directed catching surfaces 35 which extend both radially outwardly on an outer prong 160 and radially inwardly on an inner prong 161.

As seen in FIG. 18, annularly about the opening of the base portion 49, two hooking members are provided as firstly an annular axially inwardly extending resilient finger member 164 with a distal end which extends radially inwardly to provide an axially outwardly directed catch surface to engage the catching surface 35 of the outer prong 160 and secondly an annular axially inwardly extending resilient finger member 166 with a distal end which extends radially outwardly to provide an axially outwardly directed catch surface to engage the catching surface 35 of the inner prong 161. Engagement between the hooking member 34 and the finger members 164 and 166 couples the tubular portion 200 to the base portion 49 in a snap fit relation against axial movement.

The hooking member 34 has angled communing surfaces on each radially inward and radially outward side outwardly of the catching surfaces to urge the fingers 164 and 166 radially apart in insertion. While two fingers 164 and 166 are shown only one is necessary.

Operation of the embodiment illustrated in FIG. 18 is the same as the embodiment in FIG. 1. Since the outer end 204 of the tubular member 200 comprising an annular ring extending circumferentially 360 degrees, the outer end 204 is of assistance in maintaining the tubular portion 200 and the head portion 47 disposed coaxially about the axis 22 within the chamber. Preferably, in an embodiment as illustrated in FIG. 18 and in the other embodiments, the tubular member 200 is symmetrical about the central axis 22 such that with compression and expansion of the resilient tubular member 200, the tubular member has an inherent bias to maintain itself coaxially disposed about the central axis 22 which, particularly with the embodiment of FIG. 18, can avoid the need for other coaxial locating devices such as the head stem which in the other embodiments serves to assist in coaxially locating the head portion 47 coaxially slidable relative to the base portion 49.

Figure 19:
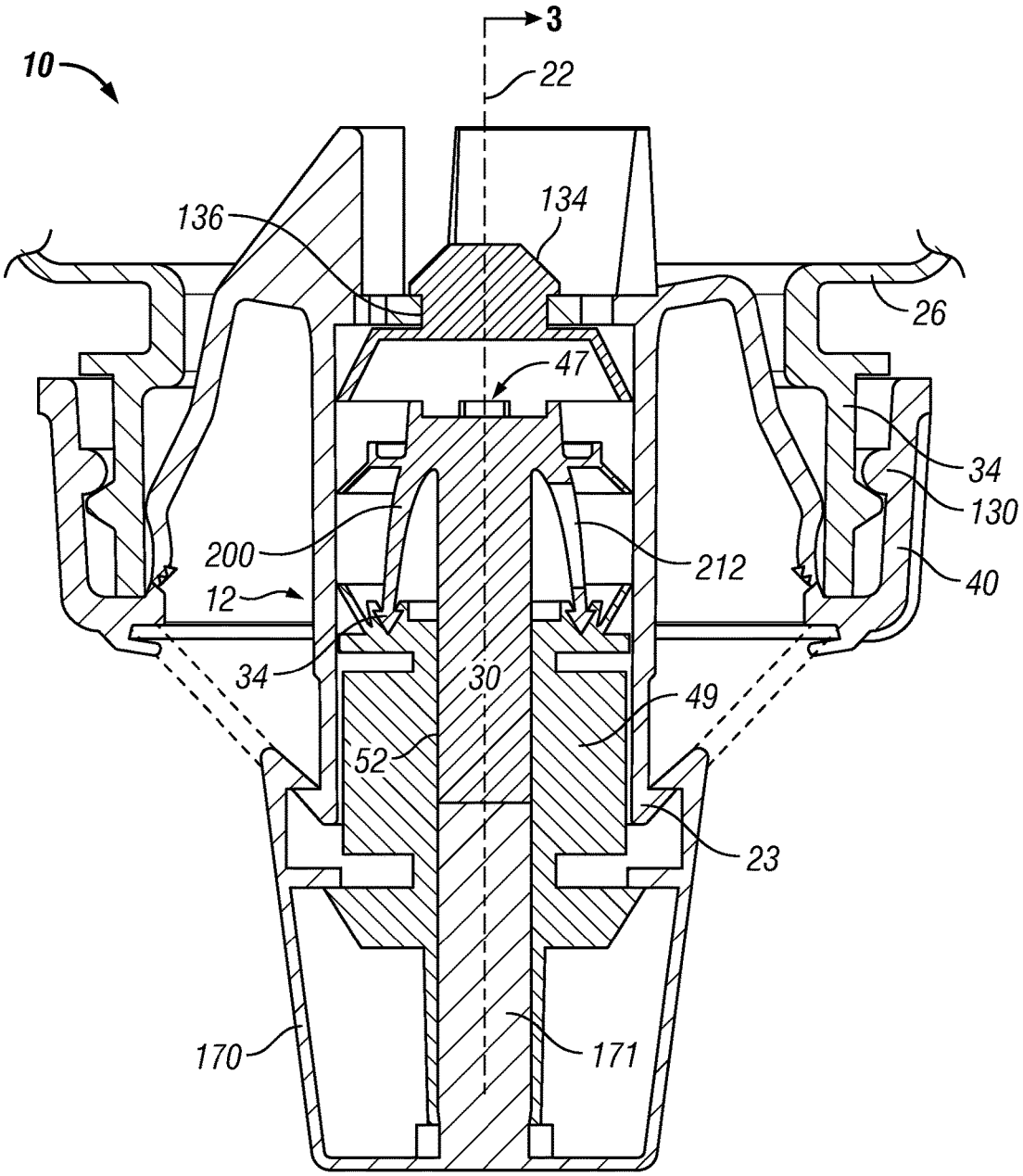
FIG. 19 is a cross-sectional side view similar to FIG. 5 but of a fourth embodiment of a pump and with the piston in an expanded condition.

Reference is made to FIG. 19 which shows a fourth embodiment of a pump in cross-section which uses a piston 16 with a head portion 47 as in the second embodiment in FIGS. 15 to 17 in which the openings 212 through the tubular members 200 close. In FIG. 19, in a manner identical to the embodiment of FIG. 18, the outer end 204 of the tubular member 200 carries a hooking member 34 adapted to engage in a hook member carried on the base portion 49 at an inner end of the base portion annularly about the inner opening of the base passageway 52.

In the embodiment of FIG. 19, the head portion 47 continues to include a cross shaped head stem 30 similar to that shown in the first embodiment, however, which does not carry the hooking members 35. In the embodiment of FIG.

19, the piston 16 is illustrated as being within body 12 similar to that shown in FIG. 1 attached to a bottle 26. In addition, a removable closure cap 170 is provided which engages the body 12 in a snap-fit relation as by a radially inwardly extending hook ring on the cap 107 engaging a radially outwardly extending hook ring about the outer end 23 of the chamber wall. The cap 170 engages the engagement flange 62 to stop the base portion 49 from movement outwardly. The cap 170 has a center post 171 which extends through the passageway 52 of the base portion stem to engage an outer end of the head stem 30 and engage the head stem 30 in a position that maintains the tubular portion 200 with its opening 212 closed preventing fluid flow outwardly. Fluid flow outwardly can also be prevented by the center post 171 preventing flow out the outlet 54. In the embodiment of FIG. 19, the openings 212 of the tubular member 200 could be formed as by injection molding at the time of forming the tubular member 200. These openings are closed on applying the cap 170 when the tubular member is stretched by engagement of the center post 171 to have its axial length increased from the inherent unbiased condition. In the embodiment of FIG. 19, the tubular member 200 could have the openings 212 open to provide fluid flow when the piston 16 is in an unbiased inherent condition. On applying the cap 170, the cap urges the head stem 30 inwardly to increase the length of the tubular portion 200 and close the openings 212.

Figure 21:
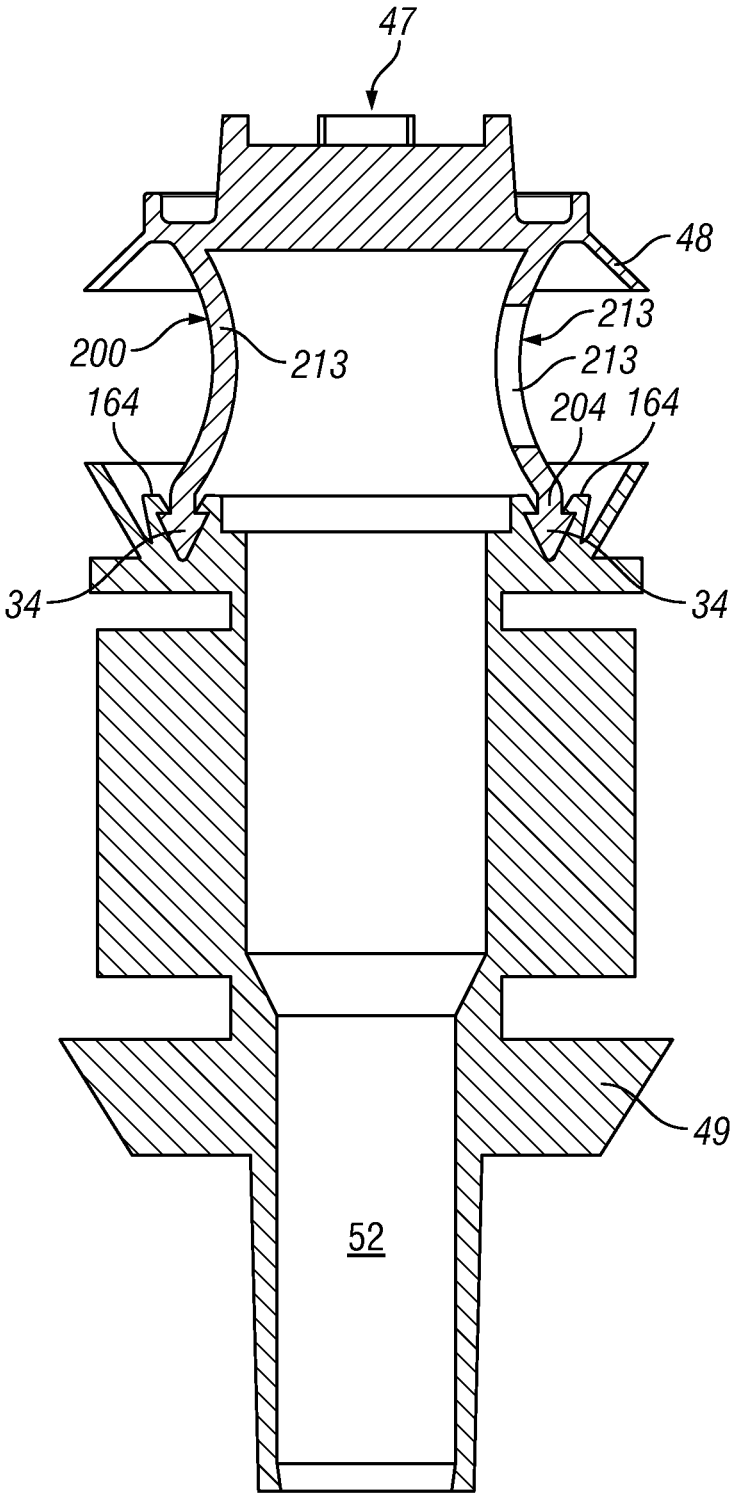
FIG. 21 is a cross-sectional view similar to FIG. 18 of a sixth embodiment of a piston for use in substitution of the piston in FIG. 1.

Reference is made to FIG. 21 which shows a sixth embodiment of a piston pump in accordance with the present invention. The embodiment of FIG. 21 is substantially the same as the embodiment illustrated in FIG. 18 with the exception that the wall of the tubular member when compressed assumes an hourglass shape as seen in side in which the outer surface 210 of the wall being convex. The extent to which the outer surface 210 is convex increases as the axial length of the tubular member 200 decreases. The openings 212 through the tubular member 200 are to be provided such that they provide for flow as desired through the wall when the tubular member 200 is compressed. The openings 212 can have configurations which, when uncompressed, they are closed and, when compressed, they are open with increased cross-sectional area.

With an hourglass shape as shown in FIG. 21, a maximum reduction in the axial length of the tubular member 200 can be a configuration in which the inner surface 208 of the webs 213 on opposite sides of the tubular member 200 engage, or in versions in which a head stem is provided, the inner surfaces 208 of the webs 213 engage the head stem. Similarly, in an embodiment in accordance with the first embodiment where the tubular member 200 expands radially outwardly, a limit on reduction of the axial length of the tubular portion 200 can be a position in which the outer surface 210 of the webs 213 extend outwardly to engage the wall 20 of the chamber 18.

The preferred embodiment in FIG. 1 illustrates the openings 212 through the wall of the tubular member as being identical openings evenly spaced circumferentially about the central axis 22. This is not necessary. Some openings 212 may be larger than other openings 212, however, a preferred configuration would be with openings 212 of comparable size symmetrically arranged relative to the central axis 22 to assist in maintaining the tubular member 200 coaxial about the central axis 22 with deflection. Insofar as it may be desired to permit the head disc 48 to tilt relative to the central axis 22, it is possible to provide openings 212 through the tubular member 200 asymmetrically about the axis such that the tubular member 200 will have a tendency when being compressed to adopt a configuration which tends to tilt the head portion to lie disposed at an angle to the central axis 22, as can be of assistance to reduce restriction to flow fluids past the head disc 48.

Figure 20:
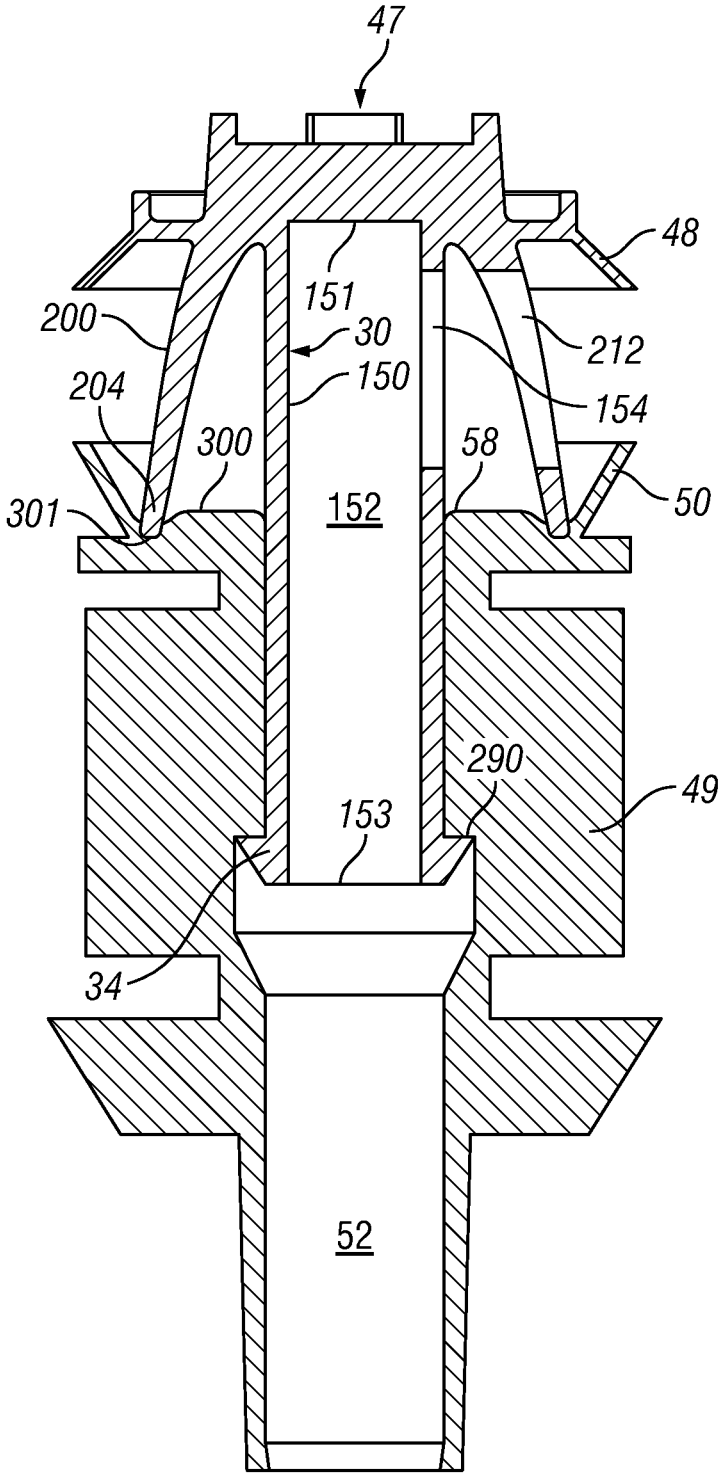
FIG. 20 is a cross-sectional side view similar to FIG. 2 but of a fifth embodiment of a piston adapted for substitution for the piston in FIG. 1 and with the piston in an uncompressed condition.

Reference is made to FIG. 20 which shows a fifth embodiment of the present invention. The fifth embodiment of FIG. 20 is identical to the first embodiment of FIG. 1 with the exception that the head stem 30 shown in the first embodiment to have an X-shape in cross-section is replaced by a tubular head stem 30 in the embodiment of FIG. 18. The tubular head stem 30 is formed with a cylindrical wall 150 and provides a head stem passageway 152 coaxial therethrough, closed at an inner end 151 and open at an outer end 153. A hooking member 34 is provided to extend radially outwardly from the exterior surface of the tubular head stem 30 and provide an axially inwardly directed catching surface 35 for engaging with the catch surface 290 on the base portion 49. One or more apertures 154 are provided through the wall 150 of the tubular head stem 30 to permit fluid flow from within the chamber 18 into the head stem passageway 152 through the tubular head stem 30 and hence into the base stem passageway 52 of the stem of the base portion to the outlet 54.

While the invention has been described with reference to preferred embodiments, many modifications and variations will now occur to persons skilled in the art. For a definition of the invention, reference is made to the following claims.

We claim:

1. A pump for dispensing fluids from a reservoir, comprising:

a piston chamber-forming member having an elongate chamber, said chamber having a chamber wall, an outer open end and an inner end in communication with the reservoir;

a one-way valve between the reservoir and the chamber permitting fluid flow through the inner end of the chamber from the reservoir to the chamber;

a piston-forming element slidably received in the chamber extending outwardly from the open end thereof;

the piston-forming element having an inner head portion, an outer base portion and a variable length portion intermediate the head portion and the base portion joining the head portion and the base portion, the base portion having a central axially extending hollow stem having a central passageway open at an outer end of the passageway forming an outlet, a head disc extending radially outwardly from the head portion engaging the chamber wall circumferentially thereabout to prevent fluid flow in the chamber past the head disc in an inward direction, the head disc elastically deforming away from the chamber wall to permit fluid flow in the chamber past the head disc in an outward direction, a base disc extending radially outwardly from the stem of the base portion axially outwardly from the head disc engaging the chamber wall circumferentially thereabout to prevent fluid flow in the chamber past the base disc in an inward direction, the base portion having a central axially extending hollow stem having a central passageway open at an outer end forming an outlet, the passageway extending from the outlet inwardly to an inner end of the passageway open to the chamber between the head disc and the base disc, the piston-forming element received in the piston chamber-forming member reciprocally coaxially slidable inwardly and outwardly by movement of the base portion in the chamber between a retracted position and an extended position in a cycle of operation to draw fluid from the reservoir and dispense it from the outlet, the piston-forming element and the chamber coaxially disposed about a central axis, the variable length portion comprising a tubular member coupled at an outer end of the tubular member to the base portion and at an inner end of the tubular member to the head portion, the tubular member transmitting axially directed tension force applied thereto by the base portion from the base portion to the head portion, the tubular member reducing in length axially between the base portion and the head portion when axially directed compression forces are applied to the tubular member by the base portion, the tubular member having a wall member extending between inner end of the tubular member and the outer end of the tubular member, the wall member having the shape of a solid of revolution rotated about the central axis, the wall member having a radially outwardly directed outer wall surface and a radially inwardly directed inner wall surface, at least one wall opening radially through the wall member from the outer wall surface to the inner wall surface, the tubular member being resilient having an inherent bias to assume an initial unbiased configuration of an unbiased length measured along the central axis, the tubular member resiliently deflectable to biased configurations each having a length measured along the central axis less than the unbiased length, the inherent bias of the resilient member biasing the tubular member to return towards the unbiased configuration from any one of the biased configurations, a reduction in the length of the tubular member as measured along the central axis corresponds to the outer wall surface increasing in convexity as seen in cross-sectional side view in flat planes including the central axis extending radially from the central axis.

2. A pump as claimed in claim 1 wherein said at least one wall opening comprises a plurality of wall openings radially through the wall member from the outer wall surface to the inner wall surface, each wall opening extending axially, the wall openings spaced circumferentially about the tubular member with each wall opening spaced circumferentially from each adjacent wall opening.

3. A pump as claimed in claim 2 wherein, the wall member at the inner end of the tubular member extending circumferentially 360 degrees about the central axis and disposed in an inner plane normal the central axis, the wall member at the outer end of the tubular member extending circumferentially 360 degrees about the central axis and disposed in an outer plane normal the central axis, the inner end of the tubular member coupled to the head portion, and the outer end of the tubular member coupled to the base portion.

4. A pump as claimed in claim 3 wherein during pumping of fluid from the reservoir with the pump:

(a) in movement of the base portion inwardly in the chamber while the length of the variable length portion is less than the unbiased length resistance to movement of the head disc inwardly in the chamber is sufficient that the length of the variable length portion decreases from the unbiased length before the head portion is substantially moved inwardly in the chamber, and (b) in movement of the base portion outwardly in the chamber while the length of the variable length portion is less than the unbiased length resistance to movement of the head disc outwardly in the chamber is sufficient that the length of the variable length portion increases toward the unbiased length before the head portion is substantially moved outwardly in the chamber.

5. A pump as claimed in claimed 2 wherein:

each wall opening has a circumferential extent which changes with a change in the length of the tubular member measured along the central axis, the circumferential extent of each wall opening increasing with a reduction in the length of the tubular member measured along the central axis.

6. A pump as claimed in claimed 5 wherein each wall opening defines a passage through which fluid may flow, each passage having a minimum cross-sectional area for fluid flow therethrough which changes with changes in the length of the tubular member measured along the central axis, the cross-sectional area of each opening increasing with a reduction in the length of the tubular member measured along the central axis.

7. A pump as claimed in claimed 6 wherein each wall opening is closed by reason of its cross-sectional area being nil to prevent fluid flow therethrough when the tubular member is in the initial unbiased configuration and each wall opening has its cross-sectional area increase as the tubular member reduces in length from the initial unbiased configuration.

8. A pump as claimed in claimed 1 wherein the base portion is a separate element from the head portion and the tubular member, inner end of the tubular member is fixedly secured to the head portion and the outer end of the tubular member is maintained in engagement with the base portion.

9. A pump as claimed in claimed 8 including a hook member on the base portion with an axially outwardly directed catch surface to engage with an axially inwardly directed catching surface of an opposed hooking member on one of the tubular portion and the head portion to limit the movement of the head portion inwardly relative the base portion to positions in which the outer end of the tubular member is maintained in engagement with the base portion.

10. A pump as claimed in claimed 8 wherein the head portion carries spaced radially inwardly of the tubular member a central axially extending head stem which extends outwardly through the open inner end of the passageway of the stem of the base portion to be coaxially slidably disposed within the passageway.

11. A pump as claimed in claimed 10 wherein:

the passageway of the stem of the base portion is defined radially inwardly of an radially inwardly directed interior wall surface of the stem of the base portion, the head stem having a radially outwardly directed exterior wall surface, portions of the exterior wall surface of the head stem spaced radially inwardly from portions of the interior wall surface of the stem of the base portion to provide therebetween an axially extending passage for fluid flow axially through the passageway of the stem of the base portion.

12. A pump as claimed in claimed 10 wherein:

the head stem is a hollow tube having a central bore therethrough closed at an inner end and open at an outer end into the passageway of the stem of the base portion, an opening radially through the hollow tube providing for fluid flow from an annular space between the tubular member and the head stem into the central bore.

13. A pump as claimed in claimed in claim 12 including an axially outwardly directed catch surface on the stem of the base portion to engage with an axially inwardly directed catching surface of a radially outwardly extending catching member on the head stem to limit the movement of the head portion inwardly relative the base portion to positions in which the outer end of the tubular member is maintained in engagement with the base portion, an axially inwardly directed annular groove is provided on the base portion coaxial about the central axis, the outer end of the tubular member engaged in the groove and engagement between the groove and the outer end of the tubular member assists in maintaining the outer end of the tubular member coaxially disposed about the central axis, the annular groove including at least one of: an axially inwardly directed surface to engage the outer end of the tubular member and prevent radially inward movement of the inner end relative the groove and an axially outwardly directed surface to engage the outer end of the tubular member and prevent radially outward movement of the inner end relative the groove.

14. A pump as claimed in claimed 9 wherein the head portion and variable length portion are formed as a unitary member by injection molding from plastic.

15. A pump as claimed in claimed 1 wherein:

in the cycle of operation during pumping of fluid from the reservoir with the pump, the piston-forming element-moving in succession:

(a) in an extension stroke:

i. from a first configuration in which the base portion is in the retracted position, the variable length portion in a compressed condition and the head portion in a inner position, ii. to a second configuration in which the head portion is in the inner position, the variable length portion in an expanded condition and the base portion is displaced outwardly from the retracted position toward the extended position, iii. to a third configuration in which the base portion is in the extended position, the variable length portion in the expanded condition and the head portion is in an outer position displaced outwardly from the inner position, and then (b) in a retraction stroke:

iv. from the third configuration to a fourth configuration in which the base portion is displaced inwardly from its extended position, the variable length portion in the compressed condition and the head portion is in the outer position, v. to the first configuration, whereby in movement from the first configuration to the second configuration, the length of the variable length portion increases and fluid in the passageway is drawn back into the chamber.

16. A pump as claimed in claim 1 wherein during pumping of fluid from the reservoir with the pump:

(a) in movement of the base portion inwardly in the chamber while the length of the variable length portion is greater than a minimum length, resistance to movement of the head disc inwardly in the chamber is sufficient that the length of the variable length portion decreases substantially to a minimum length before the head disc portion is substantially moved inwardly in the chamber, and (b) in movement of the base portion outwardly in the chamber while the length of the variable length portion is less than the maximum length, resistance to movement of the head disc outwardly in the chamber is sufficient that the length of the variable length portion increases substantially to the maximum length before the head disc portion is substantially moved outwardly in the chamber.

17. A pump as claimed in claimed 1 wherein the chamber wall is substantially circular in any cross section normal to the central axis.

18. A pump as claimed in claim 17 wherein the head disc and base disc are circular in cross-section and disposed coaxially within the chamber about the central axis.

19. A pump as claimed in claim 1 wherein one of:

(a) the base portion and the variable length portion, and (b) the head portion and variable length portion, are formed as a unitary member by injection molding from plastic.

20. A piston-forming element for reciprocal sliding coaxially within a chamber in a piston pump;

the piston-forming element disposed about a central axis and having an inner head portion, an outer base portion and a variable length tubular member intermediate the head portion and the base portion, the tubular member having an outer end and an inner end, the tubular member coupled at an outer end of the tubular member to the base portion and at the inner end of the tubular member to the head portion, a head disc extending radially outwardly from the head portion substantially preventing fluid flow in the chamber past the head disc in an inward direction and permitting fluid flow in the chamber past the head disc in an outward direction, a base disc extending radially outwardly from the base portion axially outwardly from the head disc preventing fluid flow in the chamber past the base disc in an inward direction, the base portion having a central axially extending hollow stem having a central passageway open at an outer end of the passageway forming an outlet, the passageway extending from the outlet inwardly to an inner end of the passageway open to the chamber between the head disc and the base disc, the tubular member having a wall member extending between inner end of the tubular member and the outer end of the tubular member, the wall member having the shape of a solid of revolution rotated about the central axis, the wall member having a radially outwardly directed outer wall surface and a radially inwardly directed inner wall surface, at least one wall opening radially through the wall member from the outer wall surface to the inner wall surface, the tubular member reducing in length axially between the base portion and the head portion when axially directed compression forces are applied to the tubular member, the tubular member being resilient having an inherent bias to assume an initial unbiased configuration of an unbiased length measured axially along the central axis, the tubular member resiliently deflectable to biased configurations each having a length measured axially along the central axis less than the unbiased length, the inherent bias of the tubular member biasing the tubular member to return towards the unbiased configuration from any one of the biased configurations, with a reduction in the length of the tubular member as measured axially along the central axis the outer wall surface increases in convexity as seen in cross-sectional side view in any flat plane including the central axis extending radially from the central axis.

* * * * *